US007465696B2

(12) United States Patent
Roby et al.

(10) Patent No.: US 7,465,696 B2
(45) Date of Patent: Dec. 16, 2008

(54) LUBRICATING BASE OIL COMPOSITIONS AND METHODS FOR IMPROVING FUEL ECONOMY IN AN INTERNAL COMBUSTION ENGINE USING SAME

(75) Inventors: Stephen H. Roby, Hercules, CA (US); Susanne G. Ruelas, San Pablo, CA (US)

(73) Assignee: Chevron Oronite Company, LLC, San Ramon, CA (US)

( * ) Notice: Subject to any disclaimer, the term of this patent is extended or adjusted under 35 U.S.C. 154(b) by 391 days.

(21) Appl. No.: 11/046,994

(22) Filed: Jan. 31, 2005

(65) Prior Publication Data

US 2006/0172898 A1 Aug. 3, 2006

(51) Int. Cl.
*C10M 169/04* (2006.01)
*C10G 71/00* (2006.01)

(52) U.S. Cl. ..... 508/485; 201/18; 201/19; 508/110

(58) Field of Classification Search ..... 508/485, 508/110; 208/18, 19
See application file for complete search history.

(56) References Cited

U.S. PATENT DOCUMENTS

| | | | | |
|---|---|---|---|---|
| 5,151,205 | A | 9/1992 | Culpon, Jr. | |
| 5,338,471 | A | 8/1994 | Lal | |
| 5,674,822 | A * | 10/1997 | Schlosberg et al. | 508/485 |
| 6,278,006 | B1 | 8/2001 | Kodali et al. | |
| 6,410,491 | B1 | 6/2002 | Harrison et al. | |
| 6,465,401 | B1 | 10/2002 | Kodali et al. | |
| 6,703,353 | B1 * | 3/2004 | Lok et al. | 508/110 |
| 6,943,262 | B2 | 9/2005 | Kodali et al. | |
| 7,083,713 | B2 * | 8/2006 | Abernathy et al. | 208/18 |
| 2003/0027730 | A1 | 2/2003 | Field et al. | |
| 2003/0096716 | A1 | 5/2003 | Locke et al. | |
| 2003/0166476 | A1 | 9/2003 | Winemiller et al. | |
| 2003/0176300 | A1 | 9/2003 | Kodali et al. | |
| 2003/0186824 | A1 | 10/2003 | Chiu et al. | |
| 2003/0191032 | A1 * | 10/2003 | Deckman et al. | 508/460 |
| 2004/0002429 | A1 | 1/2004 | Forbus, Jr. | |
| 2004/0043910 | A1 | 3/2004 | Lok et al. | |
| 2004/0118744 | A1 * | 6/2004 | Daniel et al. | 208/18 |
| 2004/0242433 | A1 | 12/2004 | Roby et al. | |
| 2005/0133407 | A1 | 6/2005 | Abernathy et al. | |
| 2005/0133408 | A1 | 6/2005 | Abernathy et al. | |

FOREIGN PATENT DOCUMENTS

| | | |
|---|---|---|
| EP | 0 931 827 | 7/1999 |
| EP | 1 266 954 | 12/2002 |
| EP | 1 338 643 | 8/2003 |
| GB | 2397070 | 7/2004 |
| JP | 1079299 | 3/1989 |
| WO | 99/18175 | 4/1999 |
| WO | WO 00/08119 | 2/2000 |
| WO | WO 00/14187 | 3/2000 |
| WO | WO 02/064711 | 8/2002 |
| WO | WO 03/027212 | 4/2003 |
| WO | WO 03/035585 | 5/2003 |
| WO | WO 2005/066314 | 7/2005 |

OTHER PUBLICATIONS

Lexolube Lubricant Esters at http://www.inolex.com/Web/Lubricant/Products.htmn (2002).

* cited by examiner

*Primary Examiner*—Glenn Caldarola
*Assistant Examiner*—Jim Goloboy
(74) *Attorney, Agent, or Firm*—Claude J. Caroll; M. Carmen & Associates, PLLC

(57) ABSTRACT

A lubricating base oil composition is provided comprising (a) at least one Fischer-Tropsch derived lubricating base oil characterized as having a kinematic viscosity of about 2 to about 5 centistoke (cSt) at 100° C.; and (b) at least one polyol ester. Methods for improving the fuel economy of an internal combustion engine are also provided.

48 Claims, No Drawings

LUBRICATING BASE OIL COMPOSITIONS AND METHODS FOR IMPROVING FUEL ECONOMY IN AN INTERNAL COMBUSTION ENGINE USING SAME

BACKGROUND OF THE INVENTION

1. Technical Field

The present invention generally relates to lubricating base oil compositions containing at least one Fischer-Tropsch derived lubricating base oil and at least one polyol ester and to methods for improving fuel economy in internal combustion engines using same.

2. Description of the Related Art

There is currently a need to improve the efficiency and useful life of engine oils, particularly those used as crankcase lubricants in internal combustion engines in such vehicles as, for example, automobiles and trucks. Generally, engine oils used in internal combustion engines have a limited life. Their efficacy can be curtailed by such factors as, for example, the expiration of the specific additive package that is blended into the base oil(s), breakdown of the oil in the engine due to oxidation, etc.

The viscosity grade of an engine oil is one feature when selecting a lubricating oil. The lubricating oil is typically chosen according to both the climatic temperatures to which the engine is exposed, and the temperatures and shear conditions under which the engine operates. Thus, the oil must be of sufficiently low viscosity at ambient temperatures to provide adequate lubrication upon cold starting of the engine, and capable of maintaining sufficient viscosity to lubricate the engine when it is under a full operating load.

The Society of Automotive Engineers classification system, SAE J300, defines engine oil grade viscosity specifications. Single grades are designated as SAE 20, 30, 40, 50, and 60 grade, and are defined by a low shear rate kinematic viscosity range at 100° C. (ASTM D445), as well as a minimum high shear rate viscosity at 150° C. (such as ASTM D4683, CEC L-36-A-90, or ASTM D5481). Engine oils designated as SAE 0W through 25W have been classified according to their low temperature cranking viscosities (ASTM D5293), low temperature pumping viscosities (ASTM 4684), and a minimum kinematic viscosity at 100° C. Multigrade oils meet both the high and low temperature viscosity requirements indicated in their nomenclature. For example, an engine oil designated as SAE 5W-30 possesses the viscometric characteristics of SAE 30 motor oils as well as the low temperature viscometric qualities of SAE 5W.

A lubricating oil should be chosen with the appropriate high temperature kinematic and high shear rate viscosities for a given engine type and operating conditions in an effort to prevent the engine wear and oil consumption that can be associated with inadequate boundary layer lubrication and oil thinning, respectively. Similarly, to afford low temperature engine protection, the maximum low temperature cranking and pumping viscosities of the lubricant should match the requirements imposed by the environment in which the engine will be operated. The maximum low temperature viscosity limits of a given oil grade are intended to define the oil's ability to facilitate engine starting in cold weather, and to ensure the ready flow of cold oil to the oil pump, thereby minimizing the potential of engine damage due to insufficient lubrication.

In addition to selecting the appropriate multigrade oil, it is also necessary for the internal combustion engine to have its oil changed periodically in order to maintain the efficiency and mechanical integrity of the engine. However, it is common for oil change intervals to lag behind other service intervals since consumers can view oil changes as one of the more inconvenient and, in some cases, costly regular maintenance aspects of vehicle ownership. Typically, recommended oil service intervals have been extended with the introduction of higher quality base stocks and better lubricant additive packages. Yet regular oil changes still tend to lag behind other maintenance items such as, for example, air filter replacement, brake replacement, etc.

There are also a number of situations in which there is a desire to utilize an engine oil having a prolonged service life. For example, to minimize maintenance costs and equipment downtime, leasing companies and equipment operators such as trucking companies desire engine oils that retain their original performance capabilities for prolonged periods of service. Additionally, original equipment manufacturers desire lubricating oil compositions having extended drain capabilities whereby their lease customers can operate the equipment for longer periods of time or for greater distances before draining the engine oil and replacing all or part of it with a new engine oil.

There has also been an increasing concern in recent years to improve the fuel economy performance of an internal combustion engine, particularly that of passenger car engines and diesel fuel engines. Fuel economy in the United States is federally mandated by Corporate Average Fuel Economy (CAFÉ), specifying the fleet-average fuel economy for passenger cars. Improved fuel economy can result in more environmentally desirable compositions, the use of less fuel per mile traveled, hence lower greenhouse gas emissions and also conservation of petroleum, an increasingly scarce resource. The viscosity of the engine oil is one factor that influences fuel economy. The lower the oil's viscosity the lower the viscous drag on the engine and hence the better the fuel economy performance. However, the lower viscosity grade oils must still provide adequate lubrication to protect the engine.

Accordingly, there remains a need for lubricating base oil compositions having an extended life period while also providing significantly improved fuel economy.

SUMMARY OF THE INVENTION

The present invention provides lubricating base oil compositions and methods for improving the fuel economy of an internal combustion engine employing the lubricating base oils and/or compositions. In accordance with one embodiment of the present invention, a lubricating base oil composition is provided comprising (a) at least one Fischer-Tropsch derived lubricating base oil characterized as having a kinematic viscosity of about 2 to about 5 centistoke (cSt) at 100° C.; and (b) at least one polyol ester.

In accordance with a second embodiment of the present invention, a lubricating base oil composition having a kinematic viscosity of about 2 to about 9.3 cSt at 100° C. is provided comprising (a) at least one Fischer-Tropsch derived lubricating base oil characterized as having a boiling range distribution of about 100 to about 300° F. between the 5 percent and 95 percent points by ASTM analytical method D-6352 or its equivalent; and (b) at least one polyol ester.

In accordance with a third embodiment of the present invention, a lubricating base oil composition having a kinematic viscosity of about 2 to about 9.3 cSt at 100° C. is provided comprising (a) at least one Fischer-Tropsch derived lubricating base oil comprising (i) a weight percent of all molecules having at least one aromatic function of less than about 0.30, the weight percent based on the total weight of the Fischer-Tropsch derived lubricating base oil; (ii) a weight percent of all molecules having cycloparaffinic functionality of greater than about 8; the weight percent based on the total weight of the Fischer-Tropsch derived lubricating base oil; and (iii) a ratio of weight percent of molecules having monocycloparaffinic functionality to weight percent of molecules having multicycloparaffinic functionality greater than about 15:1; and (b) at least one polyol ester.

In accordance with a fourth embodiment of the present invention, a lubricating base oil composition having a kinematic viscosity of about 2 to about 9.3 cSt at 100° C. is provided comprising (a) at least one Fischer-Tropsch derived lubricating base oil comprising (i) a weight percent of all molecules having at least one aromatic function of less than about 0.30, the weight percent based on the total weight of the Fischer-Tropsch derived lubricating base oil; (ii) a weight percent of all molecules having monocycloparaffin functionality of greater than about 8, the weight percent based on the total weight of the Fischer-Tropsch derived lubricating base oil; and (iii) a weight percent of all molecules having multicycloparaffin functionality of less than about 0.5, the weight percent based on the total weight of the Fischer-Tropsch derived lubricating base oil; and (b) at least one polyol ester.

Methods for operating an internal combustion engine comprising operating the engine with the foregoing lubricating base oil compositions are also provided.

Methods for improving the fuel economy of an internal combustion engine comprising operating the engine with the foregoing lubricating base oil compositions are also provided.

Among other factors, the present invention is based on the unexpected and surprising discovery that the lubricating base oil compositions herein advantageously have increased stability over a long period of time thereby resulting in excellent lubricating performance during extended use, e.g., up to or greater than about 30,000 miles, while also improving the fuel economy of an internal combustion engine.

DETAILED DESCRIPTION OF THE PREFERRED EMBODIMENTS

The present invention is directed to low viscosity lubricating base oil compositions which are capable of providing improved wear, deposit and oxidation resistance while also having an increased life expectancy. Generally, the lubricating base oil compositions of the present invention will include at least (a) at least one Fischer-Tropsch derived lubricating base oil; and (b) at least one polyol ester.

I. The Fischer-Tropsch Derived Lubricating Base Oil Component

The Fischer-Tropsch derived lubricating base oil component of the lubricating base oil compositions of the present invention can be prepared having very low weight percents of all molecules having at least one aromatic function, high weight percents of all molecules having cycloparaffinic functionality, and high ratios of weight percent of molecules having monocycloparaffinic functionality to weight percent of molecules having multicycloparaffinic functionality (or high weight percent of molecules having monocycloparaffinic functionality and very low weight percents of molecules having multicycloparaffinic functionality). The Fischer-Tropsch derived lubricating base oil compositions can also have moderate pour points.

Generally, the Fischer-Tropsch derived lubricating base oil component may be obtained from the steps including at least (a) performing a Fischer-Tropsch synthesis to provide a product stream, (b) isolating from the product stream a substantially paraffinic wax feed having less than about 30 ppm total combined nitrogen and sulfur, and less than about 1 weight percent oxygen, (c) dewaxing the substantially paraffinic wax feed by hydroisomerization dewaxing using a shape selective intermediate pore size molecular sieve comprising a noble metal hydrogenation component, whereby an isomerized oil is produced, and (d) hydrofinishing the isomerized oil whereby a Fischer-Tropsch derived lubricating base oil is produced having a weight percent of all molecules having at least one aromatic function of less than about 0.30, a weight percent of all molecules having cycloparaffinic functionality of greater than about 8 and preferably greater than about 9.5, and a high ratio of weight percent of molecules having monocycloparaffinic functionality to weight percent of molecules having multicycloparaffinic functionality, namely, greater than about 15:1 and preferably greater than about 45:1.

Alternatively, step (d) may be characterized as (d) hydrofinishing the isomerized oil whereby a Fischer-Tropsch derived lubricating base oil is produced having a weight percent of all molecules having at least one aromatic function of less than about 0.30, a weight percent of molecules having monocycloparaffinic functionality of greater than about 8 and preferably greater than about 9.5, and a weight percent of molecules having multicycloparaffinic functionality of less than about 0.5.

Kinematic viscosity is a measurement of the resistance to flow of a fluid under gravity. Many lubricating base oils, finished lubricants made from them, and the correct operation of equipment depend upon the appropriate viscosity of the fluid being used. All kinematic viscosity measurements herein are at a temperature of 100° C. and determined by ASTM D 445-01 with the results being reported in centistokes (cSt). In one embodiment, the kinematic viscosities of the Fischer-Tropsch derived lubricating base oil components employed in the present invention are between about 2 cSt and about 5 cSt.

Pour point is a measurement of the temperature at which the sample will begin to flow under carefully controlled conditions. Pour point may be determined as described in ASTM D 5950-02 with the results being reported in degrees Celsius. Many commercial lubricating base oils have specifications for pour point. When lubricant base oils have low pour points, they also are likely to have other good low temperature properties, such as low cloud point, low cold filter plugging point, and low temperature cranking viscosity. Cloud point is a measurement complementary to the pour point, and is expressed as a temperature at which a sample of the lubricant base oil begins to develop a haze under carefully specified conditions. Cloud point may be determined by, for example, ASTM D 5773-95. Lubricating base oils having pour-cloud point spreads below about 35° C. are also desirable. Higher pour-cloud point spreads require processing the lubricating base oil to very low pour points in order to meet cloud point specifications. The pour-cloud point spreads of the Fischer-Tropsch derived lubricating base oil components are generally less than about 35° C., preferably less than about 25° C. and more preferably less than about 10° C. The cloud points are generally in the range of +30 to −30° C.

Noack volatility of engine oil, as measured by TGA Noack and similar methods, has been found to correlate with oil consumption in passenger car engines. Strict requirements for low volatility are important aspects of several recent engine oil specifications such as, for example, ACEA A-3 and B-3 in Europe, and SAE J300-01 and ILSAC GF-3 in North America. Any new lubricating base oil developed for use in automotive engine oils should have a Noack volatility no greater than current conventional Group I or Group II Light Neutral oils. The Noack volatility of the Fischer-Tropsch derived lubricating base oil components herein are relatively low, generally less than an amount calculated by the following equation:

$$\text{Noack Volatility, Wt \%}=1000\times(\text{Kinematic Viscosity at } 100^\circ\text{ C.})^{-2.7}.$$

In another embodiment, the Noack volatility is less than an amount calculated by the following equation:

$$\text{Noack Volatility, Wt \%}=900\times(\text{Kinematic Viscosity at } 100^\circ\text{ C.})^{-2.8}.$$

Noack volatility is defined as the mass of oil, expressed in weight percent, which is lost when the oil is heated at 250° C. and 20 mmHg (2.67 kPa; 26.7 mbar) below atmospheric pressure in a test crucible through which a constant flow of air is drawn for 60 minutes (ASTM D 5800). A more convenient method for calculating Noack volatility and one which correlates well with ASTM D-5800 is by using a thermo gravimetric analyzer test (TGA) in accordance with ASTM D-6375-99. TGA Noack volatility is used throughout this disclosure unless otherwise stated.

Molecules with cycloparaffinic functionality mean any molecule that is, or contains as one or more substituents, a monocyclic or a fused multicyclic saturated hydrocarbon group. The cycloparaffinic group may be optionally substituted with one or more substituents and preferably one to three substituents. Representative examples of cycloparaffinic groups include, but are not limited to, cyclopropyl, cyclobutyl, cyclohexyl, cyclopentyl, cycloheptyl, decahydronaphthalene, octahydropentalene, (pentadecan-6-yl)cyclohexane, 3,7,10-tricyclohexylpentadecane, decahydro-1-(pentadecan-6-yl)naphthalene, and the like and mixtures thereof.

Molecules with monocycloparaffinic functionality mean any molecule that is a monocyclic saturated hydrocarbon group of three to about seven ring carbons or any molecule that is substituted with a single monocyclic saturated hydrocarbon group of three to about seven ring carbons. The cycloparaffinic group may be optionally substituted with one or more substituents and preferably one to three substituents. Representative examples of monocycloparaffinic groups include, but are not limited to, cyclopropyl, cyclobutyl, cyclohexyl, cyclopentyl, cycloheptyl, (pentadecan-6-yl)cyclohexane, and the like and mixtures thereof.

Molecules with multicycloparaffinic functionality mean any molecule that is a fused multicyclic saturated hydrocarbon ring group of two or more fused rings, any molecule that is substituted with one or more fused multicyclic saturated hydrocarbon ring groups of two or more fused rings, or any molecule that is substituted with more than one monocyclic saturated hydrocarbon groups of three to about seven ring carbons. The fused multicyclic saturated hydrocarbon ring group preferably is of two fused rings. The cycloparaffinic group may be optionally substituted with one or more substituents and preferably one to three substituents. Representative examples of multicycloparaffinic groups include, but are not limited to, decahydronaphthalene, octahydropentalene, 3,7,10-tricyclohexylpentadecane, decahydro-1-(pentadecan-6-yl)naphthalene, and the like and mixtures thereof.

Wax Feed:

The wax feed used to make the Fischer-Tropsch derived lubricating base oil component is substantially paraffinic with less than about 30 ppm total combined nitrogen and sulfur. The level of oxygen is less than about 1 weight percent, preferably less than about 0.6 weight percent, and more preferably less than about 0.2 weight percent. In most cases, the level of oxygen in the substantially paraffinic wax feed may range from about 0.01 to about 0.90 weight percent. The oil content of the feed will ordinarily be less than about 10 weight percent as determined by ASTM D 721. The term "substantially paraffinic" as used herein shall be understood to mean as having greater than about 75 mass percent normal paraffin by gas chromatographic analysis. The n-paraffin content of the waxy feed may be measured by gas chromatographic analysis, e.g., as described in U.S. patent application Ser. Nos. 10/897,906 and 10/897,501, filed on Jul. 22, 2004, the contents of which are incorporated by reference herein.

Nitrogen Determination: Nitrogen is measured by melting the substantially paraffinic wax feed prior to oxidative combustion and chemiluminescence detection using ASTM D 4629-96. The test method is further described in U.S. Pat. No. 6,503,956, the contents of which are incorporated by reference herein.

Sulfur Determination: Sulfur is measured by melting the substantially paraffinic wax feed prior to ultraviolet fluorescence using ASTM 5453-00. The test method is further described in U.S. Pat. No. 6,503,956.

Oxygen Determination: Oxygen is measured by neutron activation analysis.

The wax feed for use herein has a significant fraction with a boiling point greater than about 650° F. (343° C.). The T90 boiling points of the wax feed as determined by ASTM D 6352 can range from about 660° F. (349° C.) to about 1200° F. (649° C.), more preferably from about 900° F. (482° C.) to about 1200° F. (649° C.), and most preferably from about 1000° F. (538° C.) to about 1200° F. (649° C.). T90 refers to the temperature at which 90 weight percent of the feed has a lower boiling point.

The wax feed can have a weight ratio of molecules of at least about 60 carbon atoms to molecules of at least about 30 carbons of less than about 0.18:1. The weight ratio of molecules of at least about 60 carbons to molecules of at least about 30 carbons can be determined by (1) measuring the boiling point distribution of the Fischer-Tropsch wax by simulated distillation using ASTM D 6352, (2) converting the boiling points to percent weight distribution by carbon number, using the boiling points of n-paraffins published in Table 1 of ASTM D 6352-98, (3) summing the weight percent of feed of carbon number about 30 or greater, (4) summing the weight percent of feed of carbon number about 60 or greater, (5) dividing the sum of weight percent of feed of carbon number about 60 or greater by the sum of weight percent of feed of carbon number about 30 or greater. Other embodiments of this invention use Fischer-Tropsch wax having a weight ratio of molecules having at least about 60 carbons to molecules having at least about 30 carbons of less than about 0.15:1, or less than about 0.10:1.

The boiling range distribution of the wax feed useful in the process of this invention may vary considerably. For example the difference between the T90 and T10 boiling points, determined by ASTM D 6352, may be greater than about 95° C., or greater than about 160° C., or greater than about 200° C., or greater than about 225° C.

Fischer-Tropsch Synthesis and Fischer-Tropsch Wax

A preferred wax feed for this process is a Fischer-Tropsch wax which is a product of Fischer-Tropsch synthesis. During Fischer-Tropsch synthesis, liquid and gaseous hydrocarbons are formed by contacting a synthesis gas (syngas) containing at least a mixture of hydrogen and carbon monoxide with a Fischer-Tropsch catalyst under suitable temperature and pressure reactive conditions. The Fischer-Tropsch reaction will ordinarily be carried out at temperatures ranging from about 300° F. to about 700° F. (about 150° C. to about 370° C.), preferably from about 400° F. to about 550° F. (about 205° C. to about 230° C.); at pressures of from about 10 to about 600 psia (about 0.7 to about 41 bars), preferably about 30 to about 300 psia (about 2 to about 21 bars) and catalyst space velocities of from about 100 to about 10,000 cc/g/hr., and preferably about 300 to about 3,000 cc/g/hr.

The products resulting from the Fischer-Tropsch synthesis may range from $C_1$ to about $C_{200}$ plus hydrocarbons, with a majority in the $C_5$ to about $C_{100}$ plus range. Generally, Fischer-Tropsch synthesis may be viewed as a polymerization reaction. Thus, applying polymerization kinetics, a simple one parameter equation can describe the entire product distribution, referred to as the Anderson-Shultz-Flory (ASF) distribution:

$$W_n=(1-\alpha)^2\times n\times\alpha^{n-1}$$

wherein $W_n$ is the weight fraction of product with carbon number n, and $\alpha$ is the ASF chain growth probability. The higher the value of $\alpha$, the longer the average chain length. The ASF chain growth probability of the $C_{20}$+ fraction of the Fischer-Tropsch wax herein can range from about 0.85 to about 0.915.

The Fischer-Tropsch reaction can be carried out in a variety of reactor types such as, for example, fixed bed reactors containing one or more catalyst beds, slurry reactors, fluidized bed reactors, and the like and a combination of different types of reactors. Such reaction processes and reactors are well known and documented in the literature. The slurry Fischer-Tropsch process utilizes superior heat (and mass) transfer characteristics for the strongly exothermic synthesis reaction and is able to produce relatively high molecular weight, paraffinic hydrocarbons when using a cobalt catalyst. In the slurry process, a syngas containing at least a mixture of hydrogen and carbon monoxide is bubbled up as a third phase through a slurry which includes at least a particulate Fischer-Tropsch type hydrocarbon synthesis catalyst dispersed and suspended in a slurry liquid containing at least hydrocarbon products of the synthesis reaction which are liquid under the reaction conditions. The mole ratio of the hydrogen to the carbon monoxide may broadly range from about 0.5 to about 4, but is more typically within the range of from about 0.7 to about 2.75 and preferably from about 0.7 to about 2.5. A particularly preferred Fischer-Tropsch process is disclosed in European Patent No. EP 0609079, the contents of which are incorporated by reference herein.

Suitable Fischer-Tropsch catalysts include, but are not limited to, one or more Group VIII metals of the Period Table of the Elements such as iron (Fe), cobalt (Co), nickel (Ni), ruthenium (Ru), rhodium (Rh), palladium (Pd), rhenium (Re), osmium (Os), iridium (Ir), platinum (Pt), and the like and salts thereof, with cobalt being preferred. In general, the amount of cobalt present in the catalyst can range from about 1 to about 50 weight percent, based on the total weight of the catalyst composition. If desired, the catalysts can further contain additional components which include, but are not limited to, one or more promoters, e.g., basic oxide promoters such as $ThO_2$, $La_2O_3$, MgO, and $TiO_2$, or other promoters such as $ZrO_2$; coinage metals, e.g., Cu, Ag, and Au; transition metals, e.g., Mn; and the like and combinations thereof. The catalyst can also be formed on a support. Suitable support materials include, but are not limited to, alumina, silica, magnesia and titania, and the like and mixtures thereof. Useful catalysts and their preparation are known and illustrated in U.S. Pat. No. 4,568,663, which is intended to be illustrative but non-limiting relative to catalyst selection. A preferred Fischer-Tropsch catalyst can include effective amounts of cobalt and one or more of Re, Ru, Pt, Fe, Ni, Th, Zr, Hf, U, Mg and La on a suitable inorganic support material, e.g., titania, preferably one which includes at least one or more refractory metal oxides.

Hydroisomerization Dewaxing

As typically employed in the present invention, the substantially paraffinic wax feed is dewaxed by hydroisomerization dewaxing at conditions sufficient to produce a Fischer-Tropsch derived lubricating base oil with a desired composition of cycloparaffins and a moderate pour point. In general, the conditions for hydroisomerization dewaxing can be controlled such that the conversion of the compounds boiling above about 700° F. in the wax feed to compounds boiling below about 700° F. is maintained between about 10 wt % and 50 wt %, and preferably between 15 wt % and 45 wt %. Hydroisomerization dewaxing is intended to improve the cold flow properties of a lubricating base oil by the selective addition of branching into the molecular structure. Hydroisomerization dewaxing ideally will achieve high conversion levels of waxy feed to non-waxy iso-paraffins while at the same time minimizing the conversion by cracking.

Hydroisomerization is ordinarily conducted using a shape selective intermediate pore size molecular sieve. Hydroisomerization catalysts for use in this step include at least a shape selective intermediate pore size molecular sieve and a catalytically active metal hydrogenation component on a refractory oxide support. The phrase "intermediate pore size," as used herein means a crystallographic free diameter in the range of from about 3.9 to about 7.1 Angstrom when the porous inorganic oxide is in the calcined form. The shape selective intermediate pore size molecular sieves used in the practice of the present invention are generally 1-D 10-, 11- or 12-ring molecular sieves. The most preferred molecular sieves are of the 1-D 10-ring variety, where 10- (or 11- or 12-) ring molecular sieves have 10 (or 11 or 12) tetrahedrally-coordinated atoms (T-atoms) joined by oxygens. In the 1-D molecular sieve, the 10-ring (or larger) pores are parallel with each other, and do not interconnect. However, it is to be understood that 1-D 10-ring molecular sieves which meet the broader definition of the intermediate pore size molecular sieve but include intersecting pores having 8-membered rings may also be encompassed within the definition of the molecular sieve for use herein. The classification of intrazeolite channels as 1-D, 2-D and 3-D is set forth by R. M. Barrer in Zeolites, Science and Technology, edited by F. R. Rodrigues, L. D. Rollman and C. Naccache, NATO ASI Series, 1984 which classification is incorporated in its entirety by reference (see particularly page 75).

In one embodiment, the shape selective intermediate pore size molecular sieves used for hydroisomerization dewaxing are based upon aluminum phosphates, such as SAPO-11, SAPO-31, and SAPO-41, with SAPO-11 and SAPO-31 being preferred and SAPO-11 being most preferred. SM-3 is also a useful shape selective intermediate pore size SAPO, which has a crystalline structure falling within that of the SAPO-11 molecular sieves. The preparation of SM-3 and its unique characteristics are described in, for example, U.S. Pat. Nos. 4,943,424 and 5,158,665. Other shape selective intermediate pore size molecular sieves used for hydroisomerization dewaxing include zeolites such as, for example, ZSM-22, ZSM-23, ZSM-35, ZSM-48, ZSM-57, SSZ-32, offretite, ferrierite and the like with SSZ-32 and ZSM-23 being preferred.

A preferred intermediate pore size molecular sieve is characterized by selected crystallographic free diameters of the channels, selected crystallite size (corresponding to selected channel length), and selected acidity. Desirable crystallographic free diameters of the channels of the molecular sieves are in the range of from about 3.9 to about 7.1 Angstrom, having a maximum crystallographic free diameter of not more than about 7.1 and a minimum crystallographic free diameter of not less than about 3.9 Angstrom. Preferably, the maximum crystallographic free diameter is not more than about 7.1 and the minimum crystallographic free diameter is not less than about 4.0 Angstrom. Most preferably the maximum crystallographic free diameter is not more than about 6.5 and the minimum crystallographic free diameter is not less than about 4.0 Angstrom. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp 10-15, the contents of which are incorporated by reference herein.

If the crystallographic free diameters of the channels of a molecular sieve are unknown, the effective pore size of the molecular sieve can be measured using standard adsorption techniques and hydrocarbonaceous compounds of known minimum kinetic diameters. See Breck, Zeolite Molecular Sieves, 1974 (especially Chapter 8); Anderson et al. J. Catalysis 58, 114 (1979); and U.S. Pat. No. 4,440,871, the pertinent portions of which are incorporated by reference herein. In performing adsorption measurements to determine pore size, standard techniques are used. It is convenient to consider a particular molecule as excluded if does not reach at least about 95% of its equilibrium adsorption value on the molecular sieve in less than about 10 minutes (p/po=0.5; 25° C.). Intermediate pore size molecular sieves will typically admit molecules having kinetic diameters of about 5.3 to about 6.5 Angstrom with little hindrance.

Preferred hydroisomerization dewaxing catalysts for use herein have sufficient acidity so that about 0.5 grams thereof when positioned in a tube reactor converts at least about 50% of hexadecane at about 370° C., pressure of about 1200 psig, a hydrogen flow of about 160 ml/min, and a feed rate of about 1 ml/hr. The catalyst also exhibits isomerization selectivity of about 40 percent or greater (isomerization selectivity is determined as follows: 100×(weight % branched $C_{16}$ in product)/(weight % branched $C_{16}$ in product+weight % $C_{13-}$ in product) when used under conditions leading to an about 96% conversion of normal hexadecane (n-$C_{16}$) to other species.

Suitable hydroisomerization dewaxing catalysts include at least a catalytically active hydrogenation noble metal, e.g., platinum and palladium. The presence of a catalytically active hydrogenation metal can lead to product improvement, especially viscosity index and stability. The noble metals platinum and palladium are especially preferred, with platinum being more preferred. If platinum and/or palladium is used, the total amount of active hydrogenation metal will ordinarily not exceed about 10 weight percent of the total catalyst, and can range from about 0.1 to about 5 weight percent of the total catalyst, and preferably from about 0.1 to about 2 weight percent, based on the total weight of the catalyst.

If desired, the hydroisomerization dewaxing catalysts can be formed on a support. Suitable supports for use herein include refractory oxide support and the like. Useful refractory oxide supports can be those oxide supports which are conventionally used for catalysts such as, for example, silica, alumina, silica-alumina, magnesia, titania, and the like and combinations thereof.

The conditions for hydroisomerization dewaxing depend on such factors as, for example, the feed used, the catalyst used, whether or not the catalyst is sulfided, the desired yield, and the desired properties of the lubricant base oil. Conditions under which the hydroisomerization process for use herein may be carried out include temperatures from about 600° F. to about 750° F. (about 315° C. to about 399° C.), preferably about 600° F. to about 700° F. (about 315° C. to about 371° C.); and pressures from about 15 to about 3000 psig, and preferably from about 100 to about 2500 psig. The hydroisomerization dewaxing pressures in this context refer to the hydrogen partial pressure within the hydroisomerization reactor, although the hydrogen partial pressure is substantially the same (or nearly the same) as the total pressure. The liquid hourly space velocity during contacting is generally from about 0.1 to about 20 hr−1, and preferably from about 0.1 to about 5 hr−1. The hydrogen to hydrocarbon ratio falls within a range from about 1.0 to about 50 moles $H_2$ per mole hydrocarbon, and more preferably from about 10 to about 20 moles $H_2$ per mole hydrocarbon. Suitable conditions for performing hydroisomerization are described in U.S. Pat. Nos. 5,135,638 and 5,282,958, the contents of which are incorporated by reference herein.

Hydrogen is usually present in the reaction zone during the hydroisomerization dewaxing process, typically in a hydrogen to feed ratio ranging from about 0.5 to about 30 MSCF/bbl (thousand standard cubic feet per barrel), and preferably from about 1 to about 10 MSCF/bbl. If desired, hydrogen can be separated from the product and recycled to the reaction zone.

Hydrotreating and Hydrofinishing

Hydrotreating refers to a catalytic process, usually carried out in the presence of free hydrogen, in which the primary purpose is the removal of, for example, various metal contaminants such as arsenic, aluminum and cobalt; heteroatoms such as sulfur and nitrogen; oxygenates; and aromatics from the feed stock. Generally, in hydrotreating operations cracking of the hydrocarbon molecules, i.e., breaking the larger hydrocarbon molecules into smaller hydrocarbon molecules, is minimized and the unsaturated hydrocarbons are either fully or partially hydrogenated. The waxy feed is preferably hydrotreated prior to hydroisomerization dewaxing to form the Fischer-Tropsch derived lubricating base oils.

Catalyst compositions used in carrying out hydrotreating operations are well known in the art. See, e.g., U.S. Pat. Nos. 4,347,121 and 4,810,357, the contents of which are incorporated by reference herein, for general descriptions of hydrotreating, hydrocracking, and of typical catalysts used in each of the processes. Suitable catalysts include, but are not limited to, noble metals from Group VIIIA (according to the 1975 rules of the International Union of Pure and Applied Chemistry), such as platinum, palladium and the like and combinations thereof optionally on an alumina or siliceous matrix; Group VIII and Group VIB metals and combinations thereof, such as nickel-molybdenum or nickel-tin on an alumina or siliceous matrix. See, e.g., U.S. Pat. No. 3,852,207 which discloses a suitable noble metal catalyst and mild conditions. Other suitable catalysts are described in, for example, U.S. Pat. Nos. 3,904,513 and 4,157,294. The non-noble hydrogenation metals, such as nickel-molybdenum, are typically present in the final catalyst composition as oxides, but are usually employed in their reduced or sulfided forms when such sulfide compounds are readily formed from the particular metal involved. Catalysts containing noble metals, such as platinum, will ordinarily contain in excess of about 0.01 weight percent metal, and preferably between about 0.1 and about 1.0 weight percent metal, based on the total weight of the catalyst composition. In one embodiment, the non-noble metal catalyst compositions will ordinarily contain in excess of about 5 weight percent, preferably from about 5 to about 40 weight percent molybdenum and/or tungsten, based on the total weight of the catalyst composition, and at least about 0.5, and generally about 1 to about 15 weight percent of nickel and/or cobalt determined as the corresponding oxides, based on the total weight of the catalyst composition.

Typical hydrotreating conditions vary over a wide range. In general, the overall LHSV is about 0.25 to about 2.0, and preferably from about 0.5 to about 1.5. The hydrogen partial pressure can be greater than about 200 psia, and preferably ranging from about 500 psia to about 2000 psia. Hydrogen recirculation rates are typically greater than about 50 SCF/Bbl, and are preferably between about 1000 and about 5000 SCF/Bbl. Temperatures in the reactor will ordinarily range from about 300° F. to about 750° F. (about 150° C. to about 400° C.), and preferably from about 450° F. to about 725° F. (about 230° C. to about 385° C.).

Hydrotreating is used as a step following hydroisomerization dewaxing for preparing the Fischer-Tropsch derived lubricating base oils. This step, referred to herein as hydrofinishing, is capable of improving the oxidation stability, ultraviolet (UV) stability, and appearance of the product by removing traces of aromatics, olefins, color bodies, and solvents. The term UV stability as used herein refers to the stability of the lubricating base oil or the finished lubricant when exposed to UV light and oxygen. Instability is indicated when a visible precipitate forms, usually seen as floc or cloudiness, or a darker color develops upon exposure to ultraviolet light and air. A general description of hydrofinishing may be found in U.S. Pat. Nos. 3,852,207 and 4,673,487. If desired, clay treating can be carried out to remove these impurities as an alternative final process step.

Fractionation

Optionally, the process for preparing the Fischer-Tropsch derived lubricating base oils may further include fractionating of the substantially paraffinic wax feed prior to hydroisomerization dewaxing, or fractionating of the Fischer-Tropsch derived lubricating base oils. The fractionation of the substantially paraffinic wax feed or lubricating base oil into distillate fractions is generally accomplished by either atmospheric or vacuum distillation, or by a combination of atmospheric and vacuum distillation. Atmospheric distillation is typically used to separate the lighter distillate fractions, such as naphtha and middle distillates, from a bottoms fraction having an initial boiling point above about 600° F. to about 750° F. (about 315° C. to about 399° C.). At higher temperatures, thermal cracking of the hydrocarbons may take place leading to fouling of the equipment and to lower yields of the heavier cuts. Vacuum distillation is typically used to separate the higher boiling material, such as the lubricating base oil fractions, into different boiling range cuts. Fractionating the lubricating base oil into different boiling range cuts enables the lubricating base oil manufacturing plant to produce more than one grade, or viscosity, of lubricating base oil.

Solvent Dewaxing

Solvent dewaxing may be optionally used to remove small amounts of remaining waxy molecules from the lubricating base oil after hydroisomerization dewaxing. Solvent dewaxing can be accomplished by dissolving the Fischer-Tropsch derived lubricating base oil in a solvent such as methyl ethyl ketone, methyl iso-butyl ketone, or toluene and precipitating the wax molecules as discussed in Chemical Technology of Petroleum, 3rd Edition, William Gruse and Donald Stevens, McGraw-Hill Book Company, Inc., New York, 1960, pages 566 to 570. See also U.S. Pat. Nos. 3,775,288, 3,773,650 and 4,477,333.

Final Fischer-Tropsch Derived Lubricating Base Oil Component

The Fischer-Tropsch derived lubricating base oils employed in the present invention will typically have greater than about 95 weight percent saturates as determined by elution column chromatography, ASTM D 2549-02. Olefins are generally present in low amounts, typically less than detectable by long duration $C^{13}$ Nuclear Magnetic Resonance Spectroscopy (NMR). Molecules with at least one aromatic function are present in amounts less than about 0.3 weight percent by HPLC-UV, and confirmed by ASTM D 5292-99 modified to measure low level aromatics. In one embodiment, molecules with at least one aromatic function are present in amounts less than about 0.10 weight percent. In another embodiment, molecules with at least one aromatic function are present in amounts less than about 0.05 weight percent. In yet another embodiment, molecules with at least one aromatic function are present in amounts less than about 0.01 weight percent. Sulfur can be present in amounts less than about 25 ppm, and preferably less than about 1 ppm as determined by ultraviolet fluorescence by ASTM D 5453-00.

Aromatics Measurement by HPLC-UV

The method used herein to measure low levels of molecules with at least one aromatic function employs a Hewlett Packard 1050 Series Quaternary Gradient High Performance Liquid Chromatography (HPLC) system coupled with a HP 1050 Diode-Array UV-Vis detector interfaced to an HP Chemstation. Identification of the individual aromatic classes in the highly saturated lubricating base oils was made on the basis of their UV spectral pattern and their elution time. The amino column used for this analysis differentiates aromatic molecules largely on the basis of their ring-number (or more correctly, double-bond number). Thus, the single ring aromatic containing molecules elute first, followed by the polycyclic aromatics in order of increasing double bond number per molecule. For aromatics with similar double bond character, those with only alkyl substitution on the ring elute sooner than those with naphthenic substitution.

Unequivocal identification of the various base oil aromatic hydrocarbons from their UV absorbance spectra was accomplished recognizing that their peak electronic transitions were all red-shifted relative to the pure model compound analogs to a degree dependent on the amount of alkyl and naphthenic substitution on the ring system. These bathochromic shifts are well known to be caused by alkyl-group delocalization of the $\pi$-electrons in the aromatic ring. Since few unsubstituted aromatic compounds boil in the lubricant range, some degree of red-shift was expected and observed for all of the principle aromatic groups identified.

Quantitation of the eluting aromatic compounds was made by integrating chromatograms made from wavelengths optimized for each general class of compounds over the appropriate retention time window for that aromatic. Retention time window limits for each aromatic class were determined by manually evaluating the individual absorbance spectra of eluting compounds at different times and assigning them to the appropriate aromatic class based on their qualitative similarity to model compound absorption spectra. With few exceptions, only five classes of aromatic compounds were observed in highly saturated API Group II and III lubricating base oils.

HPLC-UV Calibration

HPLC-UV is used for identifying these classes of aromatic compounds even at very low levels. Multi-ring aromatics typically absorb 10 to 200 times more strongly than single-ring aromatics. Alkyl-substitution also affected absorption by about 20%. Therefore, it is important to use HPLC to separate and identify the various species of aromatics and know how efficiently they absorb.

Five classes of aromatic compounds have been identified. With the exception of a small overlap between the most highly retained alkyl-1-ring aromatic naphthenes and the least highly retained alkyl naphthalenes, all of the aromatic compound classes were baseline resolved. Integration limits for the co-eluting 1-ring and 2-ring aromatics at 272 nm were made by the perpendicular drop method. Wavelength dependent response factors for each general aromatic class were first determined by constructing Beer's Law plots from pure model compound mixtures based on the nearest spectral peak absorbances to the substituted aromatic analogs.

For example, alkyl-cyclohexylbenzene molecules in base oils exhibit a distinct peak absorbance at 272 nm that corresponds to the same transition that unsubstituted tetralin model compounds do at 268 nm. The concentration of alkyl-1-ring aromatic naphthenes in base oil samples was calculated by assuming that its molar absorptivity response factor at 272 nm was approximately equal to tetralin's molar absorptivity at 268 nm, calculated from Beer's law plots. Weight percent concentrations of aromatics were calculated by assuming that the average molecular weight for each aromatic class was approximately equal to the average molecular weight for the whole base oil sample.

This calibration method was further improved by isolating the 1-ring aromatics directly from the lubricating base oils via exhaustive HPLC chromatography. Calibrating directly with these aromatics eliminated the assumptions and uncertainties associated with the model compounds. As expected, the isolated aromatic sample had a lower response factor than the model compound because it was more highly substituted.

More specifically, to accurately calibrate the HPLC-UV method, the substituted benzene aromatics were separated from the bulk of the lubricating base oil using a Waters semi-preparative HPLC unit. 10 grams of sample was diluted 1:1 in n-hexane and injected onto an amino-bonded silica column, a 5 cm×22.4 mm ID guard, followed by two 25 cm×22.4 mm ID columns of 8-12 micron amino-bonded silica particles, manufactured by Rainin Instruments, Emeryville, Calif., with n-hexane as the mobile phase at a flow rate of 18 mls/min. Column eluent was fractionated based on the detector response from a dual wavelength UV detector set at 265 nm and 295 nm. Saturate fractions were collected until the 265 nm absorbance showed a change of 0.01 absorbance units, which signaled the onset of single ring aromatic elution. A single ring aromatic fraction was collected until the absorbance ratio between 265 nm and 295 nm decreased to 2.0, indicating the onset of two ring aromatic elution. Purification and separation of the single ring aromatic fraction was made by re-chromatographing the monoaromatic fraction away from the "tailing" saturates fraction which resulted from overloading the HPLC column.

This purified aromatic "standard" showed that alkyl substitution decreased the molar absorptivity response factor by about 20% relative to unsubstituted tetralin.

Confirmation of Aromatics by NMR

The weight percent of all molecules with at least one aromatic function in the purified mono-aromatic standard was confirmed via long-duration carbon 13 NMR analysis. NMR was easier to calibrate than HPLC UV because it simply measured aromatic carbon so the response did not depend on the class of aromatics being analyzed. The NMR results were translated from % aromatic carbon to % aromatic molecules (to be consistent with HPLC-UV and D 2007) by knowing that 95-99% of the aromatics in highly saturated lubricating base oils were single-ring aromatics.

High power, long duration, and good baseline analysis were needed to accurately measure aromatics down to about 0.2% aromatic molecules. More specifically, to accurately measure low levels of all molecules with at least one aromatic function by NMR, the standard D 5292-99 method was modified to give a minimum carbon sensitivity of 500:1 (by ASTM standard practice E 386). A 15-hour duration run on a 400-500 MHz NMR with a 10-12 mm Nalorac probe was used. Acorn PC integration software was used to define the shape of the baseline and consistently integrate. The carrier frequency was changed once during the run to avoid artifacts from imaging the aliphatic peak into the aromatic region. By taking spectra on either side of the carrier spectra, the resolution was improved significantly.

Determination of Weight Percent Olefins

The weight percent of olefins was determined by Proton-NMR (PROTON NMR) as set forth in the following steps, a-d:

a) preparing a solution of about 5 to about 10 weight % of the test hydrocarbon in deuterochloroform;

b) acquiring a normal proton spectrum of at least 12 ppm spectral width and accurately reference the chemical shift (ppm) axis. The instrument used must have sufficient gain range to acquire a signal without overloading the receiver/ADC. When a 30 degree pulse is applied, the instrument must have a minimum signal digitization dynamic range of about 65,000. Preferably the dynamic range will be about 260,000 or more.

c) Measuring the integral intensities between about 6.0-4.5 ppm (olefin); about 2.2-1.9 ppm (allylic); and about 1.9-0.5 ppm (saturate)

d) using the molecular weight of the test substance determined by ASTM D 2502 or ASTM D 2503, calculate the following:

1) The average molecular formula of the saturated hydrocarbons;
2) The average molecular formula of the olefins;
3) The total integral intensity (=sum of all integral intensities);
4) The integral intensity per sample hydrogen (=total integral/number of hydrogens in formula);
5) The number of olefin hydrogens (=Olefin integral/integral per hydrogen);
6) The number of double bonds (=Olefin hydrogen times hydrogens in olefin formula/2); and
7) The weight % of olefins by PROTON NMR=100 times the number of double bonds times the number of hydrogens in a typical olefin molecule divided by the number of hydrogens in a typical test substance molecule.

The weight percent olefins determined by the PROTON NMR calculation procedure as set forth is step d) works best when the resulting weight percent of olefins is low, less than about 15 weight percent. The olefins must be "conventional" olefins; i.e. a distributed mixture of those olefin types having hydrogens attached to the double bond carbons such as: alpha, vinylidene, cis, trans, and trisubstituted. These olefin types will have a detectable allylic to olefin integral ratio between about 1 and about 2.5. When this ratio exceeds about 3, it indicates a higher percentage of tri or tetra substituted olefins are present and that different assumptions must be made to calculate the number of double bonds in the sample.

Cycloparaffin Distribution by Field Ionization Mass Spectroscopy (FIMS)

Paraffins are considered more stable than cycloparaffins towards oxidation, and therefore, more desirable. Monocycloparaffins are considered more stable than multicycloparaffins towards oxidation. However, when the weight percent of all molecules with at least one cycloparaffinic function is very low in an oil, the additive solubility is low and the elastomer compatibility is poor. Examples of oils with these properties are Fischer-Tropsch oils (GTL oils) with less than about 5% cycloparaffins. To improve these properties in finished products, expensive co-solvents such as esters must often be added. Preferably, the oil fractions, derived from highly paraffinic wax and used as dielectric fluids, comprise a high weight percent of molecules with monocycloparaffinic functionality and a low weight percent of molecules with multicycloparaffinic functionality such that the oil fractions have high oxidation stability, low volatility, good miscibility with other oils, good additive solubility, and good elastomer compatibility.

The Fischer-Tropsch derived lubricant base oils employed in this invention were characterized by FIMS into alkanes and molecules with different numbers of unsaturations. The distribution of molecules in the oil fractions was determined by FIMS. FIMS spectra were obtained on a Micromass VG 70VSE mass spectrometer. The samples were introduced via a solid probe into the spectrophotometer, preferably by placing a small amount (about 0.1 mg) of the base oil to be tested in a glass capillary tube. The capillary tube was placed at the tip of a solids probe for a mass spectrometer, and the probe was heated from about 40° C. up to 500° C. at a rate of 50° C. per minute, operating under vacuum at approximately $10^{-6}$ Torr. The mass spectrometer was scanned from m/z 40 to m/z 1000 at a rate of 5 seconds per decade. The acquired mass spectra were summed to generate one "averaged" spectrum. Each spectrum was $^{13}C$ corrected using a software package from PC-MassSpec.

Response factors for all compound types were assumed to be 1.0, such that weight percent was determined from area percent. The acquired mass spectra were summed to generate one "averaged" spectrum. The output from the FIMS analysis is the average weight percents of alkanes, 1-unsaturations, 2-unsaturations, 3-unsaturations, 4-unsaturations, 5-unsaturations, and 6-unsaturations in the test sample.

The molecules with different numbers of unsaturations may be comprised of cycloparaffins, olefins, and aromatics. If aromatics were present in significant amounts in the lubricant base oil they would most likely be identified in the FIMS analysis as 4-unsaturations. When olefins were present in significant amounts in the Fischer-Tropsch derived lubricant base oil they would most likely be identified in the FIMS analysis as 1-unsaturations. The total of the 1-unsaturations, 2-unsaturations, 3-unsaturations, 4-unsaturations, 5-unsaturations, and 6-unsaturations from the FIMS analysis, minus the weight percent of olefins by proton NMR, and minus the weight percent of aromatics by HPLC-UV is the total weight percent of molecules with cycloparaffin functionality in the Fischer-Tropsch derived lubricant base oils employed in this invention. The total of the 2-unsaturations, 3-unsaturations, 4-unsaturations, 5-unsaturations, and 6-unsaturations from the FIMS analysis, minus the weight percent of aromatics by HPLC-UV is the weight percent of molecules with multicycloparaffinic functionality in the oils employed in this invention. Note that if the aromatics content was not measured, it was assumed to be less than 0.1 wt % and not included in the calculation for total weight percent of molecules with cycloparaffinic functionality.

In one embodiment, the Fischer-Tropsch derived lubricating base oils employed in this invention have a weight percent of all molecules with cycloparaffinic functionality greater than about 8 and preferably greater than about 9.5. They have a ratio of weight percent of molecules with monocycloparaffinic functionality to weight percent of molecules with multicycloparaffinic functionality greater than about 15:1, and preferably greater than about 45:1. The most preferred Fischer-Tropsch derived lubricating base oils employed in this invention have a weight percent of molecules with monocycloparaffinic functionality greater than about 9.5, and a weight percent of molecules with multicycloparaffinic functionality less than about 0.5.

The modified ASTM D 5292-99 and HPLC-UV test methods used to measure low level aromatics, and the FIMS test method used to characterize saturates are described in D. C. Kramer, et al., "Influence of Group II & III Base Oil Composition on VI and Oxidation Stability," presented at the 1999 AIChE Spring National Meeting in Houston, Mar. 16, 1999, the contents of which are incorporated by reference herein.

Although the wax feeds employed herein are essentially free of olefins, base oil processing techniques can introduce olefins, especially at high temperatures, due to 'cracking' reactions. In the presence of heat or UV light, olefins can polymerize to form higher molecular weight products that can color the base oil or cause sediment. In general, olefins can be removed by hydrofinishing or by clay treatment.

Other Fischer-Tropsch Derived Lubricating Base Oil Properties

A. Viscosity Index

The viscosity indexes of the Fischer-Tropsch derived lubricating base oils employed in this invention can be high. In a preferred embodiment they will have viscosity indexes greater than 28×Ln(Kinematic Viscosity at 100° C.)+95. For example a 4.5 cSt Fischer-Tropsch derived oil will have a viscosity index greater than about 137. The test method used to measure viscosity index is ASTM D 2270-93(1998).

B. Aniline Point

The aniline point of a Fischer-Tropsch derived lubricating base oil is the temperature at which a mixture of aniline and oil separates. ASTM D 611-01b is the method used to measure aniline point. It provides a rough indication of the solvency of the oil for materials which are in contact with the oil, such as additives and elastomers. The lower the aniline point the greater the solvency of the oil. Prior art lubricating base oils with a weight percent of all molecules with at least one aromatic function less than about 0.30, made from substantially paraffinic wax feed having less than about 30 ppm total combined nitrogen and sulfur and hydroisomerization dewaxing, tend to have high aniline points and thus poor additive solubility and elastomer compatibility. The higher amounts of all molecules with cycloparaffinic functionality in the Fischer-Tropsch derived lubricating base oils reduce the aniline point. The aniline point of the Fischer-Tropsch derived lubricating base oils will tend to vary depending on the kinematic viscosity of the lubricating base oil at 100° C. in cSt.

C. Oxidation Stability

One convenient way to measure the stability of lubricating base oils is by the use of the Oxidator BN Test, as described in U.S. Pat. No. 3,852,207. The Oxidator BN test measures the resistance to oxidation by means of a Dornte-type oxygen absorption apparatus. See R. W. Dornte "Oxidation of White Oils," Industrial and Engineering Chemistry, Vol. 28, page 26, 1936. Normally, the conditions are one atmosphere of pure oxygen at 340° F. The results are reported in hours to absorb 1000 ml of $O_2$ by 100 g. of oil. In the Oxidator BN test, 0.8 ml of catalyst is used per 100 grams of oil and an additive package is included in the oil. The catalyst is a mixture of soluble metal naphthenates in kerosene. The mixture of soluble metal naphthenates simulates the average metal analysis of used crankcase oil. The level of metals in the catalyst is as follows: Copper=6,927 ppm; Iron=4,083 ppm; Lead=80,208 ppm; Manganese=350 ppm; Tin=3565 ppm. The additive package contains 80 millimoles of zinc aryldithiophosphate per 100 grams of oil. The Oxidator BN test measures the response of a lubricating base oil in a simulated application. High values, or long times to absorb one liter of oxygen, indicate good oxidation stability. Traditionally it is considered that the Oxidator BN should be above 7 hours. For the present invention, the Oxidator BN value can be greater than about 30 hours.

D. Noack Volatility

Noack volatility is defined as the mass of oil, expressed in weight percent, which is lost when the oil is heated at 250° C. and 20 mmHg (2.67 kPa; 26.7 mbar) below atmospheric pressure in a test crucible through which a constant flow of air is drawn for 60 minutes (ASTM D 5800). A more convenient method for calculating Noack volatility and one which correlates well with ASTM D-5800 is by using a thermo gravimetric analyzer test (TGA) in accordance with ASTM D 6375-99a. TGA Noack volatility is used throughout this disclosure unless otherwise stated. The Fischer-Tropsch derived lubricating base oils can have a Noack volatility less than an amount calculated from the equation: Noack Volatility, Wt %=1000×(Kinematic Viscosity at 100° C.)$^{-2.7}$, and preferably less than an amount calculated from the equation: Noack Volatility, Wt %=900×(Kinematic Viscosity at 100° C.)$^{-2.8}$.

E. CCS Viscosity

The Fischer-Tropsch derived lubricating base oils employed in the present invention can also have excellent viscometric properties under low temperature and high shear, making them very useful in multigrade engine oils. The cold-cranking simulator apparent viscosity (CCS VIS) is a test used to measure the viscometric properties of lubricating base oils under low temperature and high shear. The test method to determine CCS VIS is ASTM D 5293-02. Results are reported in centipoise, cP. CCS VIS has been found to correlate with low temperature engine cranking. Specifications for maximum CCS VIS are defined for automotive engine oils by SAE J300, revised in June 2001. The CCS VIS measured at −35° C. of the Fischer-Tropsch derived lubricating base oils are low, preferably less than an amount calculated by the equation: CCS VIS (−35° C.), cP=38×(Kinematic Viscosity at 100° C.)$_3$, and more preferably less than an amount calculated by the equation: CCS VIS (−35° C.), cP=38×(Kinematic Viscosity at 100° C.)$^{2.8}$.

II. The Polyol Ester Component

The second component of the lubricating base oil compositions of the present invention are polyol esters. The polyol esters can be synthetically prepared by esterifying one or more polyols with one or more organic acids. The synthesis of polyol esters from one or more polyols and one or more organic acids can be performed by methods known in the art, for example, by subjecting them to dehydrating condensation in the presence of an acid catalyst.

The polyols for use in forming the polyol esters can be those having from 2 to about 10 carbon atoms and from two to six hydroxyl groups. One example of a polyol for use herein is a neopentyl polyol having 5 to 10 carbon atoms. The term "neopentyl polyol" as used herein means a polyhydric alcohol having a neopentyl group. Examples of these polyols include, but are not limited to, 1,2-propanediol, 1,3-propanediol, 1,2-butanediol, 1,3-butanediol, 2,3-butanediol, 2-ethyl-1,3-propanediol, 2-ethyl-2-butyl-1,3-propanediol, 1,3-diol, (namely, neopentyl glycol), 2,2,4-trimethyl-1,3-pentanediol, 2,2-diethylpropane-1,3-diol, 2,2-dibutylpropane-1,3-diol, 2-methyl-2-propylpropane-1,3-diol, trimethylolpropane (TMP), pentaerythritol, dipentaerythritol and the like and combinations thereof.

The organic acids for use in forming the polyol esters can be those having from 4 to about 24 carbon atoms. Examples of organic acids include, but are not limited to, butanoic acid, isobutanoic acid, pentanoic acid, isopentanoic acid, hexanoic acid, 2-ethylbutanoic acid, cyclohexanoic acid, heptanoic acid, isoheptanoic acid, methylcyclohexanoic acid, octanoic acid, dimethyl-hexanoic acid, 2-ethylhexanoic acid, 2,4,4-trimethyl-pentanoic acid, isooctanoic acid, 3,5,5-trimethylhexanoic acid, nonanoic acid, isononanoic acid, isodecanoic acid, isoundecanoic acid, 2-butyloctanoic acid, tridecanoic acid, tetradecanoic acid, hexadecanoic acid, heptadecanoic acid, octadecanoic acid, 2-ethylhexadecanoic acid, nonadecanoic acid, 2-methyloctadecanoic acid, icosanoic acid, 2-methylicosanoic acid, 3-methylnonadecanoic acid, docosanoic acid, tetradocosanoic acid, 2-methyltricosanoic acid and the like and combinations thereof.

The organic acids can also be fatty acids which are a class of compounds containing a long hydrocarbon chain and a terminal carboxylate group and are characterized as unsaturated or saturated depending upon whether a double bond is present in the hydrocarbon chain. Therefore, an unsaturated fatty acid has at least one double bond in its hydrocarbon chain whereas a saturated fatty acid has no double bonds in its fatty acid chain. Examples of unsaturated fatty acids include, but are not limited to, myristoleic acid, palmitoleic acid, oleic acid, linolenic acid and the like and combinations thereof. Examples of saturated fatty acids include, but are not limited to, caproic acid, caprylic acid, capric acid, lauric acid, myristic acid, palmitic acid, stearic acid, arachidic acid, behenic acid, lignoceric acid and the like and combinations thereof.

In another embodiment, the polyol ester is at least one glycerol ester such as a $C_4$ to about $C_{75}$ fatty acid glycerol ester and preferably a $C_6$ to about $C_{24}$ fatty acid glycerol ester. The glycerol esters for use herein can be glycerides derived from, for example, natural sources, i.e., those derived from natural sources such as plants or animals; synthetic oils and the like and combinations thereof. Useful natural oil include, but are not limited to, coconut oil, babassu oil, palm kernel oil, palm oil, olive oil, castor oil, rape oil, corn oil, beef tallow oil, whale oil, sunflower, cottonseed oil, linseed oil, tung oil, tallow oil, lard oil, peanut oil, canola oil, soya oil, and the like and combinations thereof. Useful synthetic oils include, but are not limited to, synthetic oils derived from the reaction of one or more carboxylic acids with one or more glycerols, e.g., glycerol triacetate, and the like and combinations thereof. Suitable starting oils will ordinarily contain triacylglycerols (TAGs), which contain three fatty acid chains esterified to a glycerol moiety and can be natural or synthetic. For example, TAGs such as triolein, trieicosenoin, or trierucin can be used as starting materials. TAGs are commercially available, for example, from Sigma Chemical Company (St. Louis, Mo.), or can be synthesized using standard techniques.

The foregoing glycerol esters can contain from about $C_4$ to about $C_{75}$ and preferably contain about $C_6$ to about $C_{24}$ fatty acid esters, i.e., several fatty acid moieties, the number and type varying with the source of the oil. The fatty acid moieties independently can be unsaturated or saturated fatty acids. Examples of unsaturated fatty acids include, but are not limited to, myristoleic acid, palmitoleic acid, oleic acid, linolenic acid, and the like and combinations thereof. Examples of saturated fatty acids include, but are not limited to, caproic acid, caprylic acid, capric acid, lauric acid, myristic acid, palmitic acid, stearic acid, arachidic acid, behenic acid, lignoceric acid, and the like and combinations thereof.

The acid moiety may be supplied in a fully esterfied compound or one which is less than fully esterfied, e.g., glyceryl tri-stearate, glyceryl di-laurate and glyceryl mono-oleate, respectively. As one skilled in the art will readily appreciate, the starting material can be plant derived oils, i.e., vegetable oils. Suitable vegetable oils have a monounsaturated fatty acid content of at least about 50%, based on total fatty acid content, and include, for example, rapeseed (*Brassica*), sunflower (*Helianthus*), soybean (*Glycine max*), corn (*Zea mays*), *crambe* (*Crambe*), and meadowfoam (*Limnanthes*) oil. Canola oil, which has less than 2% erucic acid, is a particularly useful rapeseed oil. Oils having a monounsaturated fatty acid content of at least 70% are also particularly useful. The monounsaturated fatty acid content can be composed of, for example, oleic acid ($C_{18:1}$), eicosenoic acid ($C_{20:1}$), erucic acid ($C_{22:1}$), or combinations thereof.

In one embodiment, the polyol esters can be glycerol esters of the general formula (I):

(I)

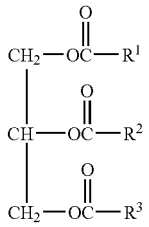

wherein $R^1$, $R^2$ and $R^3$ are independently aliphatic hydrocarbyl moieties having 4 to about 75 carbon atoms, preferably 4 to about 24 carbon atoms inclusive, and more preferably wherein at least one of $R^1$, $R^2$ and $R^3$ is a saturated aliphatic hydrocarbyl moiety having 4 to about 10 carbon atoms inclusive and wherein at least one of $R^1$, $R^2$ and $R^3$ is an aliphatic hydrocarbyl moiety having from 11 to about 24 carbon atoms inclusive.

In another embodiment, the polyol esters are compounds of the general formula (II):

(II)

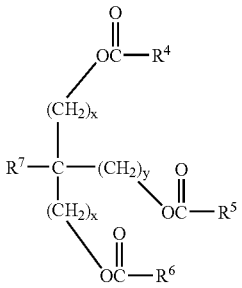

wherein $R^4$, $R^5$ and $R^6$ are independently aliphatic hydrocarbyl moieties having from 4 to about 24 carbon atoms, $R^7$ is hydrogen or an aliphatic hydrocarbyl moiety having 1 to 10 carbon atoms and x, y and z are the same or different and are integers from 1 to 10. The compounds of formula (II) are known compounds and can be prepared by known procedures and hence readily commercially available. Referring to the $R^4$, $R^5$ and $R^6$ groups, the aliphatic hydrocarbyl moieties may be independently saturated or unsaturated, linear (straight chain) or branched chain and preferably have 4 to about 24 carbon atoms, more preferably 4 to about 16 carbon atoms and most preferably 6 to about 10 carbon atoms. The $R^7$ group can be hydrogen or an aliphatic hydrocarbyl moiety such as, by way of example, a linear or branched chain alkyl group having from 1 to about 10 carbon atoms and preferably 1 to 6 carbon atoms, optionally containing an aromatic or aryl group. Examples of such polyol esters for use herein include, but are not limited to, trimethylolpropane (TMP) esters such as, for example, TMP tri(2-ethyl hexanoate), TMP triheptanoate, TMP tricaprylate, TMP tricaprate, TMP tri (isononanoate) and the like.

In general, the foregoing polyol esters can be used singly or in combination of two or more compounds with the foregoing Fischer-Tropsch derived lubricating base oils to form the lubricating base oil compositions of the present invention. The Fischer-Tropsch derived lubricating base oils will ordinarily be present in the lubricating base oil compositions in a major amount, e.g., an amount of greater than 50 wt. %, preferably greater than about 70 wt. %, more preferably from about 80 to about 99.5 wt. % and most preferably from about 85 to about 95 wt. %, based on the total weight of the lubricating base oil composition. The polyol ester will ordinarily be present in the lubricating base oil compositions in a minor effective amount, e.g., an amount ranging from about 0.5 weight percent to about 15 weight percent and preferably from about 1 weight percent to about 10 weight percent, based on the total weight of the lubricating base oil composition.

The lubricating base oil compositions of the present invention can further contain one or more lubricating oil additives for imparting auxiliary functions to form a finished lubricating oil composition in which these additives are dispersed or dissolved. The lubricating oil additives for use herein include, but are not limited to, antioxidants, anti-wear agents, detergents such as metal detergents, rust inhibitors, dehazing agents, demulsifying agents, metal deactivating agents, friction modifiers, pour point depressants, antifoaming agents, co-solvents, package compatibilisers, corrosion-inhibitors, ashless dispersants, dyes, extreme pressure agents and the like and mixtures thereof. Greases will require the addition of appropriate thickeners. A variety of the additives are known and commercially available. These additives, or their analogous compounds, can be employed for the preparation of the various lubricating oil compositions herein. The total amount of additives in the finished lubricant will fall within the range of from about 1 to about 30 weight percent.

The lubricating oil additive(s) can further contain a diluent oil to form an additive concentrate which can then be added to the lubricating base oil compositions. These concentrates usually include at least from about 90 wt. % to about 10 wt. % and preferably from about 90 wt. % to about 50 wt. %, of a diluent oil and from about 10 wt. % to about 90 wt. %, preferably from about 10 wt. % to about 50 wt. %, of the foregoing additive(s). Suitable diluents for the concentrates include any inert diluent, preferably an oil of lubricating viscosity such as, for example, a base oil, so that the concentrate may be readily mixed with lubricating oils to prepare lubricating oil compositions. Suitable lubricating oils that may be used as diluents can be any oil of lubricating viscosity.

Examples of antioxidants include, but are not limited to, aminic types, e.g., diphenylamine, phenyl-alpha-napthylamine, N,N-di(alkylphenyl)amines; and alkylated phenylene-diamines; phenolics such as, for example, BHT, sterically hindered alkyl phenols such as 2,6-di-tert-butylphenol, 2,6-di-tert-butyl-p-cresol and 2,6-di-tert-butyl-4-(2-octyl-3-propanoic)phenol; sulfur-containing materials, e.g., sulfurized olefins or esters and the like and mixtures thereof.

Examples of antiwear agents include, but are not limited to, zinc dialkyldithiophosphates and zinc diaryldithiophosphates, e.g., those described in an article by Born et al. entitled "Relationship between Chemical Structure and Effectiveness of Some Metallic Dialkyl- and Diaryl-dithiophosphates in Different Lubricated Mechanisms", appearing in Lubrication Science 4-2 Jan. 1992, see for example pages 97-100; aryl phosphates and phosphites, sulfur-containing esters, phosphosulfur compounds, metal or ash-free dithiocarbamates, xanthates, alkyl sulfides and the like and mixtures thereof.

Examples of detergents include, but are not limited to, overbased or neutral detergents such as sulfonate detergents, e.g., those made from alkyl benzene and fuming sulfuric acid; phenates (high overbased or low overbased), high overbased phenate stearates, phenolates, salicylates, phosphonates, thiophosphonates, ionic surfactants, overbased carboxylates (e.g., overbased polyisobutylene succinic anhydrides) and the like and mixtures thereof. Low overbased metal sulfonates typically have a total base number (TBN) of from about 0 to about 30 and preferably from about 10 to about 25. Low overbased metal sulfonates and neutral metal sulfonates are well known in the art.

Examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof.

Examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, preferably a $C_6$ to $C_{24}$, and most preferably a $C_6$ to $C_{20}$, fatty acid ester and a nitrogen-containing compound selected from the group consisting of ammonia, and an alkanolamine, e.g., those disclosed in U.S. Ser. No. 10/402,170, filed Mar. 28, 2003, the contents of which are incorporated by reference herein, and the like and mixtures thereof.

Examples of antifoaming agents include, but are not limited to, polymers of alkyl methacrylate; polymers of dimethylsilicone and the like and mixtures thereof.

Examples of ashless dispersants include, but are not limited to, polyalkylene succinic anhydrides; non-nitrogen containing derivatives of a polyalkylene succinic anhydride; a basic nitrogen compound selected from the group consisting of succinimides, carboxylic acid amides, hydrocarbyl monoamines, hydrocarbyl polyamines, Mannich bases, phosphonoamides, thiophosphonamides and phosphoramides; thiazoles, e.g., 2,5-dimercapto-1,3,4-thiadiazoles, mercaptobenzothiazoles and derivatives thereof; triazoles, e.g., alkyltriazoles and benzotriazoles; copolymers which contain a carboxylate ester with one or more additional polar function, including amine, amide, imine, imide, hydroxyl, carboxyl, and the like, e.g., products prepared by copolymerization of long chain alkyl acrylates or methacrylates with monomers of the above function; and the like and mixtures thereof. The derivatives of these dispersants, e.g., borated dispersants such as borated succinimides, may also be used. Preferably, the dispersants are polyalkylene succinimides derived from animation of polyalkylene succinic anhydrides with polyalkylene polyamine.

The lubricating base oil compositions of the present invention will be formulated to have a kinematic viscosity range at 100° C. ranging from about 2 cSt to about 9.3 cSt and will be selected or blended depending on the desired end use to give the desired grade of engine oil, e.g., a composition having an SAE Viscosity Grade of 0W, 0W-20, 0W-30, 0W-40, 0W-50, 0W-60, 5W, 5W-20, 5W-30, 5W-40, 5W-50, 5W-60, and the like.

The lubricating oil compositions can also be formed having only low levels of phosphorous, i.e., less than about 0.1%, preferably not exceeding about 0.08% and more preferably not exceeding about 0.05% by weight. Accordingly, the compositions of the present invention are more environmentally desirable than the higher phosphorous lubricating oil compositions generally used in internal combustion engines because they facilitate longer catalytic converter life and activity while also providing the desired high wear and deposit protection and oxidation-corrosion inhibition. This is due to the decreased levels of additives containing phosphorus compounds in these lubricating oil compositions. Conventional lubricating oil compositions, on the other hand, typically contain relatively high concentrations of such additives.

The lubricating base oil compositions herein may be formulated into premium finished lubricants which are particularly suitable for use in an internal combustion engine. The term "internal combustion engine" as used herein refers to an engine which uses a normally liquid or gaseous fuel, such as, for example, natural gas, gasoline, diesel fuel and the like. Internal combustion engines include, but are not limited to, gasoline piston engines and diesel engines. The engine may be either of the two-stroke or four-stroke design. The finished lubricants of the invention are used to lubricate the various engine parts, including, for example, the cylinder walls, bearings, and the valve train, i.e., the valves and the camshaft. In automobile engines the valve train is generally one of two designs, the overhead valve design and the overhead cam design.

The internal combustion engine may further include a turbocharger which as used herein refers to an exhaust driven pump that compresses the intake air and forces it into the combustion chambers at higher than atmospheric pressure. The internal combustion engine may also include an exhaust gas after-treatment device, such as a catalytic converter or particulate trap, which is intended to reduce pollutants in the engine exhaust.

The following non-limiting examples are illustrative of the present invention.

EXAMPLE 1

The additive package used in the following examples was formed containing the additives set forth below in Table 1.

TABLE 1

| COMPONENTS | AMOUNT* |
|---|---|
| Borated succinimide dispersant | 3.2 wt. % |
| Ashless dispersant | 5.2 wt. % |
| Low overbased calcium sulfonate | 0.34 wt. % |
| High overbased calcium sulfonate | 1.55 wt. % |
| Dialkylated diphenyl amine | 1.5 wt. % |
| Secondary zinc dialkyldithiophosphate | 0.66 wt. % |
| Ashless dithiocarbamate | 0.5 wt. % |
| Molybdenum/succinimide complex | 0.75 wt. % |
| Silicon-based foam inhibitor | 5.0 PPM |
| Viscosity modifier | 4.10 wt. % |
| Pour point depressant | 0.2 wt. % |

*Concentrations are based on the total weight of the lubricating oil composition Each of the additives in Table 1 are described as follows:

Borated succinimide dispersant prepared from polyisobutylene, succinic anhydride, and a polyethylene polyamine; and post-treated with boric acid.

Ashless dispersant—An ashless succinimide dispersant prepared from 2300 molecular weight polyisobutylene, succinic anhydride, and a polyethylene polyamine; and post-treated with ethylene carbonate.

Low overbased calcium sulfonate detergent containing about 2.4% calcium and about 2.7% sulfur, and having a total base number (TBN by ASTM D2896) of 17.

High overbased calcium sulfonate detergent containing about 17.1% calcium and about 0.9% sulfur, and having a total base number (TBN by ASTM D2896) of 425.

Dialkylated diphenylamine ashless antioxidant.

Secondary zinc dialkyldithiophosphate (ZnDTP)

Ashless dithiocarbamate.

Molybdenum/succinimide complex antioxidant containing 5.5 wt. % molybdenum.

Silicon-based foam inhibitor.

Shear stable olefin copolymer viscosity modifier.

Pour Point Depressant.

EXAMPLE 2

A lubricating oil composition was formed by adding to a lubricating base oil composition of 90 wt. % of Fischer-Tropsch derived base oil identified herein as CHEVCA4FT and 10 wt. % of Emery 2925 (a triesterified polyol ester derived from $C_8$-$C_{10}$ acids) available from Cognis Corporation (Ambler, Pa.), the additive package of Example 1. The product lubricating oil composition had a kinematic viscosity of 8.1 cSt at 100° C. and a phosphorous content of approximately 0.05 wt. %.

CHEVCA4FT Fischer-Tropsch derived base oil can be characterized as set forth in Table 2.

TABLE 2

| PROPERTIES<br>Wax Feed | CHEVCA4FT<br>Fe-Based FT Wax |
|---|---|
| Hydroisomerization Temp, ° F. | 682 |
| Hydroisomerization Dewaxing Catalyst | Pt/SAPO-11 |
| Reactor Pressure, psig | 1000 |
| Viscosity at 100° C., cSt | 4.524 |
| Viscosity Index | 149 |
| Aromatics, wt % | 0.0109 |
| Olefins by Proton NMR, Wt % | 0.9 |

TABLE 2-continued

| PROPERTIES<br>Wax Feed | CHEVCA4FT<br>Fe-Based FT Wax |
|---|---|
| FIMS Analysis, Weight % | |
| Alkanes | 89.4 |
| 1-Unsaturations | 10.4 |
| 2-6-Unsaturations | 0.2 |
| Total | 100.0 |
| Molecules with Cycloparaffinic Functionality, Weight % by FIMS | 9.7 |
| Molecules with Multicycloparaffinic Functionality, Weight % by FIMS | 0.2 |
| Pour Point, ° C. | −17 |
| Cloud Point, ° C. | −10 |
| Molecules with Mono/Multi-cycloparaffinic Functionality | 47.5 |
| Ratio of Pour Point/Vis100 | −3.76 |
| Hydroisomerization Temp. ° F. | 682 |
| Base Oil Pour Factor | −6.91 |
| Oxidator BN, Hours | 34.92 |
| Aniline Point, D 611, ° F. | 253.2 |
| Noack Volatility, Wt % | 12.53 |
| CCS Viscosity @ −35 C., Cp | 2090 |

COMPARATIVE EXAMPLE A

A lubricating oil composition was formed by adding to a lubricating base oil composition of 90 wt. % of CHEVTXPA4 (a Group IV base oil) commercially available from Chevron-Texaco Corporation (San Ramon, Calif.) and 10 wt. % of Emery 2925 (a triesterified polyol ester derived from $C_8$-$C_{10}$ acids) available from Cognis Corporation (Ambler, Pa.), the additive package of Example 1. The product lubricating oil composition had a kinematic viscosity of 7.5 cSt at 100° C. and a phosphorous content of approximately 0.05 wt. %.

COMPARATIVE EXAMPLE B

A lubricating oil composition was formed by adding to a lubricating base oil composition of 90 wt. % of Exxon 150N (a Group I base oil) commercially available from EXXON-MOBIL Corporation and 10 wt. % of Emery 2925 (a triesterified polyol ester derived from $C_8$-$C_{10}$ acids) available from Cognis Corporation (Ambler, Pa.), the additive package of Example 1. The product lubricating oil composition had a kinematic viscosity of 9.8 cSt at 100° C. and a phosphorous content of approximately 0.05 wt. %.

COMPARATIVE EXAMPLE C

A lubricating oil composition was formed by adding to a lubricating base oil composition of 90 wt. % of Chevron 100N (a Group II base oil) commercially available from Chevron-Texaco Corporation (San Ramon, Calif.) and 10 wt. % of Emery 2925 (a triesterified polyol ester derived from $C_8$-$C_{10}$ acids) available from Cognis Corporation (Ambler, Pa.), the additive package of Example 1. The product lubricating oil composition had a kinematic viscosity of 8.6 cSt at 100° C. and a phosphorous content of approximately 0.05 wt. %.

EXAMPLE 3

Thin Film Oxygen Uptake Test

The Thin Film Oxygen Uptake Test (TFOUT) was conducted according to the standard test method specified in ASTM D 4742.

The test oil compositions of Example 1 and Comparative Examples A-C were each mixed in a glass container with three other liquids that were used to simulate engine conditions: (1) an oxidized/nitrated fuel component, (2) a mixture of soluble metal naphthenates (lead, copper, iron, manganese, and tin naphthenates), and (3) distilled water.

The glass container holding the oil mixture was placed in a high pressure reactor equipped with a pressure gage. The high pressure reactor was sealed, charged with oxygen to a pressure of 620 kPa (90 psig), and placed in an oil bath at 160° C. at an angle of 30° from the horizontal. The high pressure reactor was rotated axially at a speed of 100 rpm forming a thin film of oil within the glass container resulting in a relatively large oil-oxygen contact area.

The pressure of the high pressure reactor was recorded continuously from the beginning of the test and the test was terminated when a rapid decrease of the high pressure reactor pressure was observed. The period of time that elapses between the time when the high pressure reactor was placed in the oil bath and the time at which the pressure began to decrease rapidly was called the oxidation induction time and was used as a measure of the relative oil oxidation stability. The longer times indicates better oxidative stability.

The results of this test are set forth in Table 3. The test data clearly shows that the lubricating oil composition of the present invention offers superior protection against oxidative breakdown relative to the oil compositions of Comparative Examples A-C.

EXAMPLE 4

Komatsu Hot Tube Test

The Komatsu Hot Tube Test (KHTT) is used for screening and quality control of deposit formation performance for engine oils and other oils subjected to high temperatures.

A glass tube was placed inside an aluminum block and a small air hose was attached to a holder at the bottom of the glass tube. A 5-ml syringe and 12-inch flexible tubing were filled with the oil sample. The tubing was attached to the holder above the air hose and oil was steadily introduced into the glass tube. Air forces the oil up the glass tube through the heating block for the duration of the test. After 16 hours, the glass tubes were removed, rinsed and rated against a standard. The rating, between 0 and 10, was reported. The test was often run at several temperatures to determine the deposit performance over a temperature range. Temperatures frequently tested were between 230° C. and 330° C. Note: high numbers are desirable, a ten being a perfectly clean tube.

The results of this test are set forth in Table 3. The lubricating oil composition of the present invention gave a 6.5 rating versus a 4.5 to 7.0 for the lubricating oil compositions of Comparative Examples A-C. Thus, the lubricating oil composition of the present invention provided improved or relatively equal deposit control compared to the oil compositions of Comparative Examples A-C. Accordingly, the lubricating oil composition of the present invention afforded very good deposit control.

EXAMPLE 5

Four-Ball Weld Test

The Four-Ball Weld Test (FBWT) was conducted according to the standard test method specified in ASTM D 2783.

The test was operated with one steel ball under load rotating against three steel balls held stationary in the form of a cradle. Test lubricant covered the lower three balls. The rotating speed was 1760 rpm. The machine and test lubricant were brought to 18.33° C. to 35.0° C. (65° F. to 95° F.) and then a series of tests of 10-second duration were made at increasing loads until welding occurred. Ten tests were made below the welding point. If ten loads had not been run when welding occurred and the scars at loads below seizure were within 5% of the compensation line, no further runs were necessary.

The results of this test are set forth in Table 3. The lubricating oil composition of the present invention gave a load wear index of 35.4. Accordingly, as the data shows, the lubricating oil composition of the present invention provided significantly improved or relatively equal wear control compared to the oil compositions of Comparative Examples A-C.

Moreover, the last non-seizure load showed much the same results. That is, the lubricating oil composition of the present invention was at least comparable and usually superior in wear performance to the lubricating oil compositions of Comparative Examples A-C.

TABLE 3

| TEST | Comp. Ex. A | Comp. Ex. B | Comp. Ex. C | Example 1 |
|---|---|---|---|---|
| TFOUT[1] | 712 | 230 | 940 | >1440 |
| KHTT[2] | 7 | 4.5 | 6.5 | 6.5 |
| Load Wear Index[3] | | | | |
| LWI, KGF[4] | 35.27 | 42.7 | 50.7 | 35.4 |
| Last Non Seizure Load, KGF | 80 | 100 | 126 | 80 |
| Weld, KGF | 200 | 200 | 200 | 200 |

[1]Thin film oxygen uptake test
[2]Komatsu hot tube test
[3]Four ball weld test
[4]kilograms of force It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A lubricating base oil composition comprising (a) at least one Fischer-Tropsch derived lubricating base oil comprising (i) a weight percent of all molecules having at least one aromatic function of less than about 0.30, the weight percent based on the total weight of the Fischer-Tropsch derived lubricating oil; (ii) a weight percent of all molecules having cycloparaffinic functionality of greater than about 8, the weight percent based on the total weight of the Fischer-Tropsch derived lubricating oil; and (iii) a ratio of weight percent of molecules having monocycloparaffinic functionality to weight percent of molecules having multicycloparaffinic functionality greater than about 15:1, wherein the Fischer-Tropsch derived lubricating base oil has a kinematic viscosity of about 2 to about 5 centistoke (cSt) at 100° C.; and (b) at least one polyol ester.

2. The lubricating base oil composition of claim 1, wherein the weight percent of all molecules having at least one aromatic function is less than about 0.05.

3. The lubricating base oil composition of claim 1, wherein the ratio of weight percent of molecules having monocycloparaffinic functionality to weight percent of molecules having multicycloparaffinic functionality is greater than about 45:1.

4. The lubricating base oil composition of claim 1, wherein the Fischer-Tropsch derived lubricating base oil has a boiling range distribution of about 100 to about 300° F. between the 5 percent and 95 percent points by analytical method ASTM D-6352 or its equivalent.

5. The lubricating base oil composition of claim 1, wherein the polyol ester comprises a reaction product of one or more polyols with one or more organic acids.

6. The lubricating base oil composition of claim 5, wherein the one or more polyols have from 2 to about 10 carbon atoms and from two to six hydroxyl groups and the one or more organic acids have from 4 to about 24 carbon atoms.

7. The lubricating base oil composition of claim 5, wherein the one or more polyols are polyhydric alcohols having a neopentyl group.

8. The lubricating base oil composition of claim 5, wherein the one or more polyols are selected from the group consisting of 1,2-propanediol, 1,3-propanediol, 1,2-butanediol, 1,3-butanediol, 2,3-butanediol, 2-ethyl-1,3- propanediol, 2-ethyl-2-butyl-1,3-propanediol, 2,2-dimethylpropane-1,3-diol, (namely, neopentyl glycol), 2,2,4-trimethyl-1,3-pentanediol, 2,2-diethylpropane-1,3-diol, 2,2-dibutylpropane-1,3-diol, 2-methyl-2-propylpropane-1,3-diol, trimethylolpropane (TMP), pentaerythritol, dipentaerythritol and combinations thereof; and the one or more organic acids are selected from the group consisting of butanoic acid, isobutanoic acid, pentanoic acid, isopentanoic acid, hexanoic acid, 2-ethylbutanoic acid, cyclohexanoic acid, heptanoic acid, isoheptanoic acid, methylcyclohexanoic acid, octanoic acid, dimethyl-hexanoic acid, 2-ethyihexanoic acid, 2,4,4-trimethyl-pentanoic acid, isooctanoic acid, 3,5,5-trimethyihexanoic acid, nonanoic acid, isononanoic acid, isodecanoic acid, isoundecanoic acid, 2-butyloctanoic acid, tridecanoic acid, tetradecanoic acid, hexadecanoic acid, heptadecanoic acid, octadecanoic acid, 2-ethyihexadecanoic acid, nonadecanoic acid, 2-methyloctadecanoic acid, icosanoic acid, 2-methylicosanoic acid, 3-methylnonadecanoic acid, docosanoic acid, tetradocosanoic acid, 2-methyltricosanoic acid and combinations thereof.

9. The lubricating base oil composition of claim 5, wherein the one or more polyols are selected from the group consisting of 1,2-propanediol, 1,3-propanediol, 1,2-butanediol, 1,3-butanediol, 2,3-butanediol, 2-ethyl-1,3-propanediol, 2-ethyl-2-butyl-1,3-propanediol, 2,2-dimethylpropane-1,3-diol, (namely, neopentyl glycol), 2,2,4-trimethyl-1,3-pentanediol, 2,2-diethylpropane-1,3-diol, 2,2-dibutylpropane-1,3-diol, 2-methyl-2-propylpropane-1,3-diol, trimethylolpropane (TMP), pentaerythritol, dipentaerythritol and combinations thereof; and the one or more organic acids are unsaturated or saturated fatty acids selected from the group consisting of myristoleic acid, palmitoleic acid, oleic acid, linolenic acid, caproic acid, caprylic acid, capric acid, lauric acid, myristic acid, palmitic acid, stearic acid, arachidic acid, behenic acid, lignoceric acid and combinations thereof.

10. The lubricating base oil composition of claim 1, wherein the polyol ester is a triesterified polyol ester.

11. The lubricating base oil composition of claim 1, wherein the Fischer-Tropsch derived lubricating base oil is present in a major amount and the polyol ester is present in a minor amount.

12. The lubricating base oil composition of claim 1, having a kinematic viscosity from about 2 to about 9.3 cSt at 100° C.

13. The lubricating base oil composition of claim 1, further comprising one or more lubricating oil additives selected from the group consisting of antioxidants, anti-wear agents, detergents, rust inhibitors, dehazing agents, demulsifying agents, metal deactivating agents, friction modifiers, pour point depressants, antifoaming agents, co-solvents, package compatibilisers, corrosion-inhibitors, ashless dispersants, dyes, extreme pressure agents and combinations thereof.

14. The lubricating base oil composition of claim 13, having a kinematic viscosity from about 2 to about 9.3 cSt at 100° C.

15. The lubricating base oil composition of claim 13, having a phosphorous content not exceeding about 0.08 wt. %, based on the total weight of the composition.

16. The lubricating oil composition of claim 13, having a phosphorous content not exceeding about 0.05 wt. %, based on the total weight of the composition.

17. A lubricating base oil composition having a kinematic viscosity of about 2 to about 9.3 cSt at 100° C. and comprising (a) at least one Fischer-Tropsch derived lubricating base oil comprising (i) a weight percent of all molecules having at least one aromatic function of less than about 0.30, the weight percent based on the total weight of the Fischer-Tropsch derived lubricating oil; (ii) a weight percent of all molecules having cycloparaffinic functionality of greater than about 8, the weight percent based on the weight of the Fischer-Tropsch derived lubricating oil; and (iii) a ratio of weight percent of molecules having monocycloparaffinic functionality to weight percent of molecules having multicycloparaffinic functionality greater than about 15:1, wherein the Fischer-Tropsch derived lubricating base oil has a boiling range distribution of about 100 to about 300° F. between the 5 percent and 95 percent points by analytical method D-6352 or its equivalent; and (b) at least one polyol ester.

18. The lubricating base oil composition of claim 17, wherein the weight percent of all molecules having at least one aromatic function is less than about 0.05.

19. The lubricating base oil composition of claim 17, wherein the ratio of weight percent of molecules having monocycloparaffinic functionality to weight percent of molecules having multicycloparaffinic functionality is greater than about 45:1.

20. The lubricating base oil composition of claim 17, wherein the polyol ester comprises a reaction product of one or more polyols with one or more organic acids.

21. The lubricating base oil composition of claim 20, wherein the one or more polyols have from 2 to about 10 carbon atoms and from two to six hydroxyl groups and the one or more organic acids have from 4 to about 24 carbon atoms.

22. The lubricating base oil composition of claim 20, wherein the one or more polyols are selected from the group consisting of 1,2-propanediol, 1,3-propanediol, 1,2-butanediol, 1,3-butanediol, 2,3-butanediol, 2-ethyl-1,3-propanediol, 2-ethyl-2-butyl-1,3-propanediol, 2,2-dimethylpropane-1,3-diol, (namely, neopentyl glycol), 2,2,4-trimethyl-1,3-pentanediol, 2,2-diethylpropane-1,3-diol, 2,2-dibutylpropane-1,3-diol, 2-methyl-2-propylpropane-1,3-diol, trimethyloipropane (TMP), pentaerythritol, dipentaerythritol and combinations thereof; and the one or more organic acids are selected from the group consisting of butanoic acid, isobutanoic acid, pentanoic acid, isopentanoic acid, hexanoic acid, 2-ethylbutanoic acid, cyclohexanoic acid, heptanoic acid, isoheptanoic acid, methylcyclohexanoic acid, octanoic acid, dimethyl-hexanoic acid, 2-ethyihexanoic acid, 2,4,4-trimethyl-pentanoic acid, isooctanoic acid, 3,5,5-trimethyihexanoic acid, nonanoic acid, isononanoic acid, isodecanoic acid, isoundecanoic acid, 2-butyloctanoic acid, tridecanoic acid, tetradecanoic acid, hexadecanoic acid, heptadecanoic acid, octadecanoic acid, 2-ethyihexadecanoic acid, nonadecanoic acid, 2-methyloctadecanoic acid, icosanoic acid, 2-methylicosanoic acid, 3-methylnonadecanoic acid, docosanoic acid, tetradocosanoic acid, 2-methyltricosanoic acid and combinations thereof.

23. The lubricating base oil composition of claim 20, wherein the one or more polyols are selected from the group consisting of 1,2-propanediol, 1,3-propanediol, 1,2-butanediol, 1,3-butanediol, 2,3-butanediol, 2-ethyl-1,3-propanediol, 2-ethyl-2-butyl-1,3-propanediol, 2,2-dimethylpropane-1,3-diol, (namely, neopentyl glycol), 2,2,4-trimethyl-1,3-pentanediol, 2,2-diethyipropane-1,3-diol, 2,2-dibutylpropane-1,3-diol, 2-methyl-2-propylpropane-1,3-diol, trimethylolpropane (TMP), pentaerythritol, dipentaerythritol and combinations thereof; and the one or more organic acids are unsaturated or saturated fatty acids selected from the group consisting of myristoleic acid, palmitoleic acid, oleic acid, linolenic acid, caproic acid, caprylic acid, capric acid, lauric acid, myristic acid, palmitic acid, stearic acid, arachidic acid, behenic acid, lignoceric acid and combinations thereof.

24. The lubricating base oil composition of claim 17, wherein the Fischer-Tropsch derived lubricating base oil is present in a major amount and the polyol ester is present in a minor amount.

25. The lubricating base oil composition of claim 17, further comprising one or more lubricating oil additives selected from the group consisting of antioxidants, anti-wear agents, detergents, rust inhibitors, dehazing agents, demulsifying agents, metal deactivating agents, friction modifiers, pour point depressants, antifoaming agents, co-solvents, package compatibilisers, corrosion-inhibitors, ashless dispersants, dyes, extreme pressure agents and combinations thereof.

26. The lubricating base oil composition of claim 17, having a phosphorous content not exceeding about 0.08 wt. %, based on the total weight of the composition.

27. A lubricating base oil composition having a kinematic viscosity from about 2 to about 9.3 cSt at 100° C. and comprising (a) at least one Fischer-Tropsch derived lubricating base oil comprising (i) a weight percent of all molecules having at least one aromatic function of less than about 0.30, the weight percent based on the total weight of the Fischer-Tropsch derived lubricating oil; (ii) a weight percent of all molecules with cycloparaffinic functionality of greater than about 8, the weight percent based on the weight of the Fischer-Tropsch derived lubricating oil; and (iii) a ratio of weight percent of molecules with monocycloparaffinic functionality to weight percent of molecules having multicycloparaffinic functionality greater than about 15:1; and (b) at least one polyol ester.

28. The lubricating base oil composition of claim 27, wherein the weight percent of all molecules having cycloparaffinic functionality for the Fischer-Tropsch derived lubricating base oil is greater than about 9.5.

29. The lubricating base oil composition of claim 27, wherein the polyol ester comprises a reaction product of one or more polyols with one or more organic acids.

30. The lubricating base oil composition of claim 29, wherein the one or more polyols have from 2 to about 10 carbon atoms and from two to six hydroxyl groups and the one or more organic acids have from 4 to about 24 carbon atoms.

31. The lubricating base oil composition of claim 29, wherein the one or more polyols are selected from the group consisting of 1,2-propanediol, 1,3-propanediol, 1,2-butanediol, 1,3-butanediol, 2,3-butanediol, 2-ethyl-1,3-propanediol, 2-ethyl-2-butyl-1,3-propanediol, 2,2-dimethylpropane-1,3-diol, (namely, neopentyl glycol), 2,2,4-trimethyl-1,3-pentanediol, 2,2-diethylpropane-1,3-diol, 2,2-dibutyipropane-1,3-diol, 2-methyl-2-propylpropane-1,3-diol, trimethylolpropane (TMP), pentaerythritol, dipentaerythritol and combinations thereof; and the one or more organic acids are selected from the group consisting of butanoic acid, isobutanoic acid, pentanoic acid, isopentanoic acid, hexanoic acid, 2-ethylbutanoic acid, cyclohexanoic acid, heptanoic acid, isoheptanoic acid, methylcyclohexanoic acid, octanoic acid, dimethyl-hexanoic acid, 2-ethylhexanoic acid, 2,4,4-trimethyl-pentanoic acid, isooctanoic acid, 3,5,5-trimethylhexanoic acid, nonanoic acid, isononanoic acid, isodecanoic acid, isoundecanoic acid, 2-butyloctanoic acid, tridecanoic acid, tetradecanoic acid, hexadecanoic acid, heptadecanoic acid, octadecanoic acid, 2-ethyihexadecanoic acid, nonadecanoic acid, 2-methyloctadecanoic acid, icosanoic acid, 2-methylicosanoic acid, 3-methylnonadecanoic acid, docosanoic acid, tetradocosanoic acid, 2-methyltricosanoic acid and combinations thereof.

32. The lubricating base oil composition of claim 29, wherein the one or more polyols are selected from the group consisting of 1,2-propanediol, 1,3-propanediol, 1,2-butanediol, 1,3-butanediol, 2,3-butanediol, 2-ethyl-1,3-propanediol, 2-ethyl-2-butyl-1,3-propanediol, 2,2-dimethyipropane-1,3-diol, (namely, neopentyl glycol), 2,2,4-trimethyl-1,3-pentanediol, 2,2-diethyipropane-1,3-diol, 2,2-dibutylpropane-1,3-diol, 2-methyl-2-propylpropane-1,3-diol, trimethylolpropane (TMP), pentaerythritol, dipentaerythritol and combinations thereof; and the one or more organic acids are unsaturated or saturated fatty acids selected from the group consisting of myristoleic acid, palmitoleic acid, oleic acid, linolenic acid, caproic acid, caprylic acid, capric acid, lauric acid, myristic acid, palmitic acid, stearic acid, arachidic acid, behenic acid, lignoceric acid and combinations thereof.

33. The lubricating base oil composition of claim 27, wherein the Fischer-Tropsch derived lubricating base oil is present in a major amount and the polyol ester is present in a minor amount.

34. The lubricating base oil composition of claim 27, further comprising one or more lubricating oil additives selected from the group consisting of antioxidants, anti-wear agents, detergents, rust inhibitors, dehazing agents, demulsifying agents, metal deactivating agents, friction modifiers, pour point depressants, antifoaming agents, co-solvents, package compatibilisers, corrosion-inhibitors, ashless dispersants, dyes, extreme pressure agents and combinations thereof.

35. The lubricating base oil composition of claim 27, having a phosphorous content not exceeding about 0.08 wt. %, based on the total weight of the composition.

36. A lubricating base oil composition having a kinematic viscosity from about 2 to about 9.3 cSt at 100° C. and comprising (a) at least one Fischer-Tropsch derived lubricating base oil comprising (i) a weight percent of all molecules having at least one aromatic function of less than about 0.30, (ii) a weight percent of all molecules having monocycloparaffins of greater than about 8, and (iii) a weight percent of all molecules with multicycloparaffins of less than about 0.5 said weight percent based on the weight of the Fischer-Tropsch derived lubricating oil; and (b) at least one polyol ester.

37. The lubricating base oil composition of claim 36, wherein the weight percent of all molecules having cycloparaffinic functionality for the Fischer-Tropsch derived lubricating base oil is greater than about 9.5.

38. The lubricating base oil composition of claim 36, wherein the polyol ester comprises a reaction product of one or more polyois with one or more organic acids.

39. The lubricating base oil composition of claim 38, wherein the one or more polyols have from 2 to about 10 carbon atoms and from two to six hydroxyl groups and the one or more organic acids have from 4 to about 24 carbon atoms.

40. The lubricating base oil composition of claim 38, wherein the one or more polyols are selected from the group consisting of 1,2-propanediol, 1,3-propanediol, 1,2-butanediol, 1,3-butanediol, 2,3-butanediol, 2-ethyl-1,3-propanediol, 2-ethyl-2-butyl-1,3-propanediol, 2,2-dimethylpropane-1,3-diol, (namely, neopentyl glycol), 2,2,4-trimethyl-1,3-pentanediol, 2,2-diethyipropane-1,3-diol, 2,2-dibutylpropane-1,3-diol, 2-methyl-2-propylpropane-1,3-diol, trimethylolpropane (TMP), pentaerythritol, dipentaerythritol and combinations thereof; and the one or more organic acids are selected from the group consisting of butanoic acid, isobutanoic acid, pentanoic acid, isopentanoic acid, hexanoic acid, 2-ethylbutanoic acid, cyclohexanoic acid, heptanoic acid, isoheptanoic acid, methylcyclohexanoic acid, octanoic acid, dimethyl-hexanoic acid, 2-ethylhexanoic acid, 2,4,4-trimethyl-pentanoic acid, isooctanoic acid, 3,5,5-trimethylhexanoic acid, nonanoic acid, isononanoic acid, isodecanoic acid, isoundecanoic acid, 2-butyloctanoic acid, tridecanoic acid, tetradecanoic acid, hexadecanoic acid, heptadecanoic acid, octadecanoic acid, 2-ethyihexadecanoic acid, nonadecanoic acid, 2-methyloctadecanoic acid, icosanoic acid, 2-methylicosanoic acid, 3-methylnonadecanoic acid, docosanoic acid, tetradocosanoic acid, 2-methyltricosanoic acid and combinations thereof.

41. The lubricating base oil composition of claim 38, wherein the one or more polyols are selected from the group consisting of 1,2-propanediol, 1,3-propanediol, 1,2-butanediol, 1,3-butanediol, 2,3-butanediol, 2-ethyl-1,3-propanediol, 2-ethyl-2-butyl-1,3-propanediol, 2,2-dimethylpropane-1,3-diol, (namely, neopentyl glycol), 2,2,4-trimethyl-1,3-pentanediol, 2,2-diethylpropane-1,3-diol, 2,2-dibutylpropane-1,3-diol, 2-methyl-2-propylpropane-1,3-diol, trimethylolpropane (TMP), pentaerythritol, dipentaerythritol and combinations thereof; and the one or more organic acids are unsaturated or saturated fatty acids selected from the group consisting of myristoleic acid, palmitoleic acid, oleic acid, linolenic acid, caproic acid, caprylic acid, capric acid, lauric acid, myristic acid, palmitic acid, stearic acid, arachidic acid, behenic acid, lignoceric acid and combinations thereof.

42. The lubricating base oil composition of claim 36, wherein the Fischer-Tropsch derived lubricating base oil is present in a major amount and the polyol ester is present in a minor effective amount.

43. The lubricating base oil composition of claim 36, further comprising one or more lubricating oil additives selected from the group consisting of antioxidants, anti-wear agents, detergents, rust inhibitors, dehazing agents, demulsifying agents, metal deactivating agents, friction modifiers, pour point depressants, antifoaming agents, co-solvents, package compatibilisers, corrosion-inhibitors, ashless dispersants, dyes, extreme pressure agents and combinations thereof.

44. The lubricating base oil composition of claim 36, having a phosphorous content not exceeding about 0.08 wt. %, based on the total weight of the composition.

45. A method for improving the fuel economy of an internal combustion engine comprising operating the engine with the lubricating base oil composition of claim 1.

46. A method for improving the fuel economy of an internal combustion engine comprising operating the engine with the lubricating base oil composition of claim 17.

47. A method for improving the fuel economy of an internal combustion engine comprising operating the engine with the lubricating base oil composition of claim 27.

48. A method for improving the fuel economy of an internal combustion engine comprising operating the engine with the lubricating base oil composition of claim 36.

* * * * *